US009440755B2

(12) United States Patent
Aoki et al.

(10) Patent No.: US 9,440,755 B2
(45) Date of Patent: Sep. 13, 2016

(54) LIQUID CONTAINER AND LIQUID CONSUMPTION APPARATUS

(71) Applicant: SEIKO EPSON CORPORATION, Tokyo (JP)

(72) Inventors: Yuji Aoki, Nagano (JP); Masaru Takahashi, Nagano (JP); Yoshikatsu Yamamoto, Nagano (JP); Hisao Tanaka, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 95 days.

(21) Appl. No.: 13/736,482

(22) Filed: Jan. 8, 2013

(65) Prior Publication Data

US 2013/0186513 A1 Jul. 25, 2013

(30) Foreign Application Priority Data

| | | |
|---|---|---|
| Jan. 13, 2012 | (JP) | 2012-005347 |
| Jan. 25, 2012 | (JP) | 2012-013238 |
| Feb. 6, 2012 | (JP) | 2012-022830 |
| Feb. 6, 2012 | (JP) | 2012-022831 |

(51) Int. Cl.

| | |
|---|---|
| ***B41J 2/17*** | (2006.01) |
| ***B41J 2/175*** | (2006.01) |
| ***B65B 3/04*** | (2006.01) |
| ***B65B 3/02*** | (2006.01) |

(52) U.S. Cl.

CPC ..... *B65B 3/045* (2013.01); *B41J 2/1752* (2013.01); *B41J 2/17513* (2013.01); *B41J 2/17553* (2013.01); *B41J 2/17559* (2013.01); *B65B 3/027* (2013.01)

(58) Field of Classification Search

USPC ..... 141/10, 23, 65, 71, 72, 73, 314; 347/86

See application file for complete search history.

(56) References Cited

U.S. PATENT DOCUMENTS

| | | | | |
|---|---|---|---|---|
| 5,896,151 | A * | 4/1999 | Miyazawa et al. | 347/86 |
| 6,106,112 | A * | 8/2000 | Okubo et al. | 347/86 |
| 6,220,702 | B1 * | 4/2001 | Nakamura et al. | 347/86 |
| 6,422,674 | B1 | 7/2002 | Hinami et al. | |
| 6,435,673 | B1 * | 8/2002 | Hattori et al. | 347/86 |
| 6,591,874 | B2 * | 7/2003 | Credle, Jr. | 141/10 |
| 6,609,789 | B1 * | 8/2003 | Hunt | 347/86 |
| 7,814,656 | B2 * | 10/2010 | Prasad | 29/890.1 |

(Continued)

FOREIGN PATENT DOCUMENTS

| | | |
|---|---|---|
| CA | 2782610 A1 | 12/2011 |
| CN | 101130309 A | 2/2008 |

(Continued)

*Primary Examiner* — Mark A Laurenzi
*Assistant Examiner* — Andrew Schmid
(74) *Attorney, Agent, or Firm* — Global IP Counselors, LLP

(57) ABSTRACT

A liquid container includes a liquid containing bag and a case member. The liquid containing bag includes a flat end portion extending in a first direction. The case member defines an opening at one end and accommodates the liquid containing bag inserted from the opening in the first direction. The case member has an end portion accommodating section extending in the first direction and accommodating at least the end portion of the liquid containing bag, a main portion accommodating section accommodating a main portion of the liquid containing bag, and a partition wall that partitions the end portion accommodating section and the main portion accommodating section. The partition wall includes a slit extending along the first direction, with the end portion of the liquid containing bag being inserted through the slit.

14 Claims, 17 Drawing Sheets

(56) References Cited

U.S. PATENT DOCUMENTS

| | | | | |
|---|---|---|---|---|
| 7,984,980 | B2 | 7/2011 | Kachi | |
| D656,184 | S * | 3/2012 | Iwamuro et al. | D18/56 |
| 8,197,045 | B2 * | 6/2012 | Takeuchi | 347/86 |
| D682,929 | S * | 5/2013 | Aoki et al. | D18/56 |
| D682,930 | S * | 5/2013 | Aoki et al. | D18/56 |
| D682,931 | S * | 5/2013 | Aoki et al. | D18/56 |
| D712,466 | S * | 9/2014 | Nagashima et al. | D18/56 |
| 2003/0234844 | A1 * | 12/2003 | Yamamoto et al. | 347/86 |
| 2006/0012638 | A1 | 1/2006 | Lee | |
| 2006/0038865 | A1 * | 2/2006 | Nagasaki et al. | 347/86 |
| 2007/0229622 | A1 | 10/2007 | Kawamura | |
| 2008/0049081 | A1 | 2/2008 | Hayashi et al. | |
| 2008/0106575 | A1 | 5/2008 | Shimizu et al. | |
| 2008/0136878 | A1 | 6/2008 | Nozawa et al. | |
| 2008/0151018 | A1 * | 6/2008 | Aoki et al. | 347/86 |
| 2008/0198211 | A1 * | 8/2008 | Aoki et al. | 347/86 |
| 2008/0252669 | A1 * | 10/2008 | Aoki et al. | 347/6 |
| 2008/0252702 | A1 * | 10/2008 | Aoki et al. | 347/86 |
| 2008/0284810 | A1 | 11/2008 | Shimizu et al. | |
| 2008/0316249 | A1 * | 12/2008 | Aoki et al. | 347/19 |
| 2009/0064501 | A1 * | 3/2009 | Kimura et al. | 29/890.1 |
| 2009/0167828 | A1 | 7/2009 | Ito et al. | |
| 2009/0289971 | A1 | 11/2009 | Gilson et al. | |
| 2009/0303299 | A1 | 12/2009 | Gilson et al. | |
| 2011/0198360 | A1 * | 8/2011 | Aoki | 220/694 |
| 2011/0199439 | A1 * | 8/2011 | Aoki | 347/85 |
| 2011/0205284 | A1 | 8/2011 | Yoshino et al. | |
| 2012/0147102 | A1 * | 6/2012 | Aoki et al. | 347/86 |
| 2012/0200646 | A1 * | 8/2012 | Karasawa et al. | 347/86 |
| 2012/0200871 | A1 * | 8/2012 | Takahashi et al. | 358/1.9 |
| 2012/0212526 | A1 * | 8/2012 | Karasawa et al. | 347/7 |
| 2012/0242762 | A1 | 9/2012 | Gilson et al. | |
| 2013/0182050 | A1 * | 7/2013 | Aoki et al. | 347/86 |
| 2013/0182051 | A1 * | 7/2013 | Aoki et al. | 347/86 |
| 2013/0186513 | A1 * | 7/2013 | Aoki et al. | 141/10 |
| 2013/0187993 | A1 * | 7/2013 | Aoki et al. | 347/86 |
| 2013/0188985 | A1 * | 7/2013 | Takahashi et al. | 399/110 |
| 2013/0194357 | A1 * | 8/2013 | Karasawa et al. | 347/86 |
| 2013/0201260 | A1 * | 8/2013 | Aoki et al. | 347/85 |
| 2013/0223877 | A1 | 8/2013 | Takahashi et al. | |
| 2013/0278687 | A1 * | 10/2013 | Karasawa et al. | 347/86 |
| 2013/0307908 | A1 * | 11/2013 | Aoki et al. | 347/86 |

FOREIGN PATENT DOCUMENTS

| | | | |
|---|---|---|---|
| CN | 102036828 | A | 4/2011 |
| CN | 102285237 | A | 12/2011 |
| EP | 1004447 | A2 | 5/2000 |
| EP | 3997297 | A1 | 5/2000 |
| EP | 1504908 | A2 | 2/2005 |
| EP | 1547783 | A2 | 6/2005 |
| EP | 1892103 | A2 | 2/2008 |
| EP | 2308337 | A1 | 12/2011 |
| EP | 2397336 | A1 | 12/2011 |
| JP | 63-176635 | U | 11/1988 |
| JP | 2000-218813 | A | 8/2000 |
| JP | 2006-072285 | A | 3/2006 |
| JP | 2006-212846 | A | 8/2006 |
| JP | 2007-083677 | A | 4/2007 |
| JP | 2007-083678 | A | 4/2007 |
| JP | 2007-083679 | A | 4/2007 |
| JP | 2007-083680 | A | 4/2007 |
| JP | 2007-098594 | A | 4/2007 |
| JP | 2007083677 | A * | 4/2007 |
| JP | 2007-196648 | A | 8/2007 |
| JP | 2007-268984 | A | 10/2007 |
| JP | 2008-018671 | A | 1/2008 |
| JP | 2008-087159 | A | 4/2008 |
| JP | 2008-137376 | A | 6/2008 |
| JP | 2008-273173 | A | 11/2008 |
| JP | 2009-226687 | A | 10/2009 |
| JP | 2010-228377 | A | 10/2010 |
| JP | 2012-000858 | A | 1/2012 |
| JP | 2012-226289 | A | 11/2012 |

* cited by examiner

LIQUID CONTAINER AND LIQUID CONSUMPTION APPARATUS

CROSS-REFERENCE TO RELATED APPLICATIONS

This application claims priority to Japanese Patent Application No. 2012-005347 filed on Jan. 13, 2012, Japanese Patent Application No. 2012-013238 filed on Jan. 25, 2012, Japanese Patent Application No. 2012-022830 filed on Feb. 6, 2012, and Japanese Patent Application No. 2012-022831 filed on Feb. 6, 2012, the disclosures of which are hereby incorporated herein by reference in its entirety.

TECHNICAL FIELD

The present invention relates to a liquid container.

PRIOR ART

Typically, ink cartridges which contain ink in an inner portion are mounted in printing apparatuses which use ink as a printing material. For example, a flexible ink pack is arranged in an inner portion in the ink cartridge which is described in Japanese Unexamined Patent Application Publication No. 2007-83677 and the ink is filled into the ink pack.

SUMMARY

In the technique which is described in Japanese Unexamined Patent Application Publication No. 2007-83677, the ink cartridge is formed by interposing the ink pack between an upper case and a lower case after the ink is filled into the ink pack. However, there have been cases with this technique where the work of interposing the ink pack between the upper case and the lower case is difficult in the manufacturing of the ink cartridge when the ink is filled into the ink pack. As such, there is a demand for a technique where it is possible to efficiently manufacture ink cartridges. This problem is common to liquid containers which are able to contain various types of liquids without being limited to ink.

The present invention has been made to solve at least a portion of the problems described above and is able to be realized in the following forms or application examples.

A liquid container according to one aspect includes a liquid containing bag which is provided with a flat end portion which extends in a first direction and a case member which is provided with an opening at one end and which contains the liquid containing bag by being inserted from the opening in the first direction, wherein the case member has an end portion accommodating section which extends in the first direction and which contains at least an end portion of the liquid containing bag, a main portion accommodating section which contains a main portion of the liquid containing bag, and a partition wall which partitions the end portion accommodating section and the main portion accommodating section, and a slit, where it is possible for the end portion of the liquid containing bag to be inserted through, is formed in the partition wall along the first direction.

In this aspect, since it is possible to inject liquid into the liquid containing bag in a state where it is possible to freely insert the flat end portion of the liquid containing bag through into the slit, it is possible to suppress the generation of wrinkles or folds in the ink pack inside the case member during the injection of the liquid. As a result, it is possible to smoothly inject the liquid and it is possible to efficiently manufacture the liquid container.

In the liquid container according to the above described aspect, an end portion of the one end side of the slit and an end portion of the one end side of the end portion accommodating section are preferably linked with the opening and an end portion of the one end side of the end portion accommodating section is widened toward the opening. In this embodiment, it is possible to easily contain the end portion of the liquid container in the end portion accommodating section when the liquid containing bag is inserted inside the case member.

In the liquid container according to the above described aspects, a chamfer is preferably carried out along the first direction in a portion where the slit is formed in the partition wall. In this aspect, it is possible to easily insert the end portion of the liquid container through into the slit.

In the liquid container according to any one of the above described aspects, a length of an inner circumference along a second direction of the liquid containing bag and a length of an inner circumference along the second direction of the main portion accommodating section are preferably substantially the same. In this aspect, it is possible to fill the liquid into every corner inside the main portion accommodating section.

In the liquid container according to any one of the above described aspects, liquid is preferably injected into the liquid containing bag in a state where the end portion is accommodated in the end portion accommodating section and the main portion is accommodated in the main portion accommodating section. In this aspect, it is possible to efficiently manufacture the liquid container since the liquid is injected after the liquid containing bag is inserted inside the case member.

A liquid consumption apparatus according to another aspect includes the liquid container according to the above described aspects, and configured and arranged to consume liquid accommodated in the liquid container. In this manner, it is also possible to realize the present invention as an embodiment of the liquid consumption apparatus.

A method of manufacturing a liquid container according to another aspect includes: a step (A) for preparing a liquid containing bag, which is provided with a flat first end portion which extends in a first direction and a case member which is provided with an opening at one end, a step (B) for inserting the liquid containing bag inside the case member from the opening along the first direction, and a step (C) for injecting a liquid into the liquid containing bag after the step (B), wherein the case member has a first end portion accommodating section which extends in the first direction and which contains at least the first end portion of the liquid containing bag, a main portion accommodating section which contains a main portion of the liquid containing bag, and a first partition wall which partitions the first end portion accommodating section and the main portion accommodating section, a first slit, where it is possible for the first end portion of the liquid containing bag to be inserted through, is formed along the first direction in the first partition wall, and in the step (B), the liquid containing bag is inserted inside the case member while the first end portion of the liquid containing bag passes through the first slit along the first direction.

In this manufacturing method, it is possible to easily assemble the liquid container since the liquid containing bag is inserted inside the case member while the first end portion of the liquid containing bag passes through the first slit. In addition, it is possible to efficiently fill the liquid inside the case member since the liquid is injected into the liquid containing bag after the liquid containing bag is inserted inside the case member.

In the method of manufacturing according to the above described aspect, the liquid containing bag preferably further has a flat second end portion which opposes the first end portion, the case member is preferably further provided with a second end portion accommodating section which contains the second end portion of the liquid containing bag, and a second partition wall which partitions the second end portion accommodating section and the main portion accommodating section, a second slit, where it is possible for the second end portion of the liquid containing bag to be inserted through is formed along the first direction in the second partition wall, the first end portion accommodating section has a flat space along the first partition wall, the second end portion accommodating section has a flat space along the second partition wall, and in the step (B), the first end portion and the second end portion are each folded back in opposite directions toward a direction which is orthogonal to the first direction, and the liquid containing bag is inserted inside the case member while the first end portion passes through the first slit and the second end portion passes through the second slit both in the first direction. In this embodiment, it is possible to easily insert the first end portion and the second end portion of the liquid containing bag into the flat first end portion accommodating section and second end portion accommodating section.

In the method of manufacturing according to the above described aspects, in the step (C), the liquid is preferably injected into the liquid containing bag in a state where the case member is interposed by a support member. In this embodiment, it is possible to spread the liquid to every corner inside the liquid containing bag since it is possible to suppress the swelling of the case member.

In addition to the liquid container, the liquid consumption apparatus, and the method of manufacturing a liquid container which are described above, it is also possible to realize the present invention using various types of embodiments such as a method of using a liquid container or a liquid consumption apparatus.

DESCRIPTION OF THE EMBODIMENTS

Figure 1:
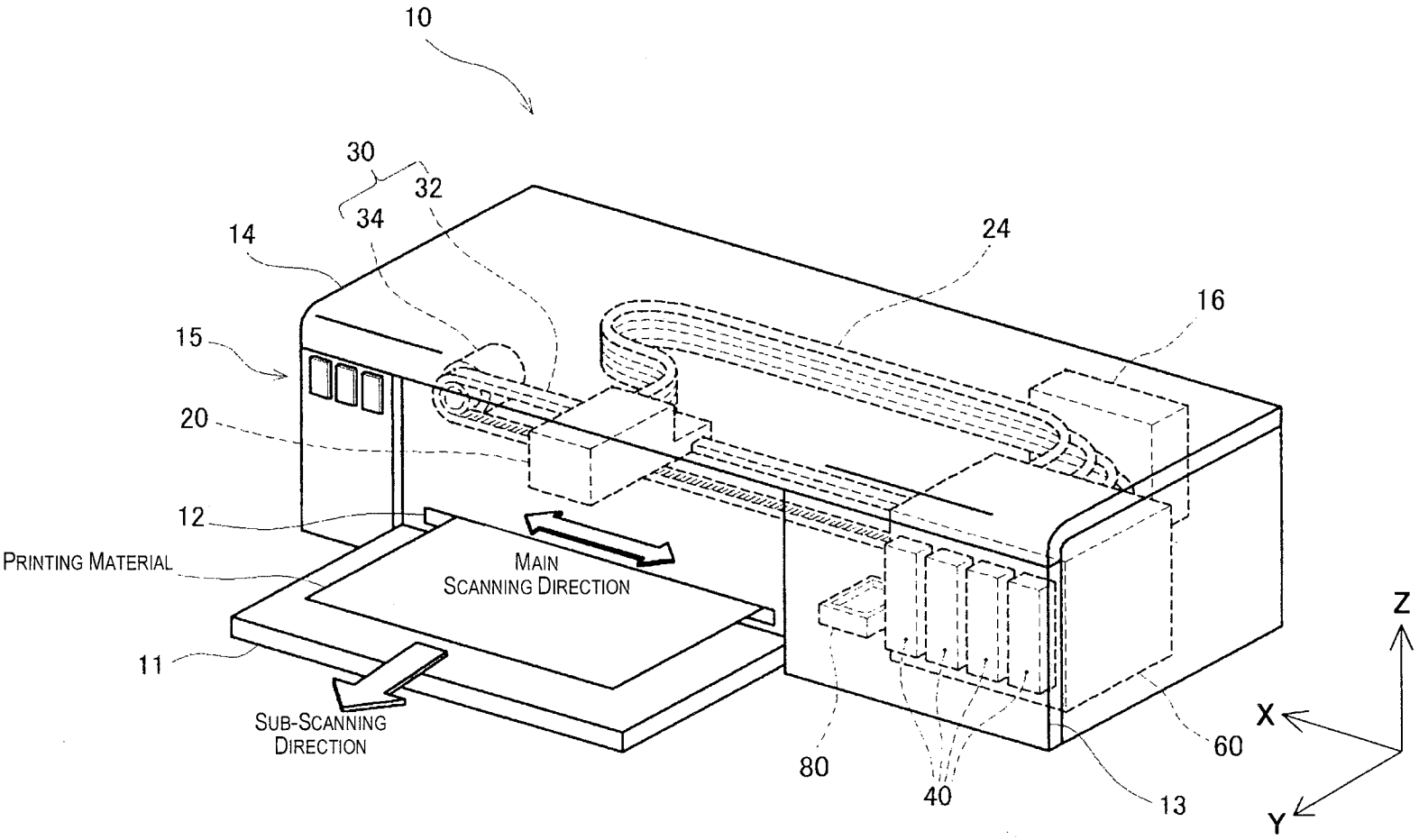
FIG. 1 is a diagram illustrating a schematic configuration of a printing apparatus.
Figure 6:
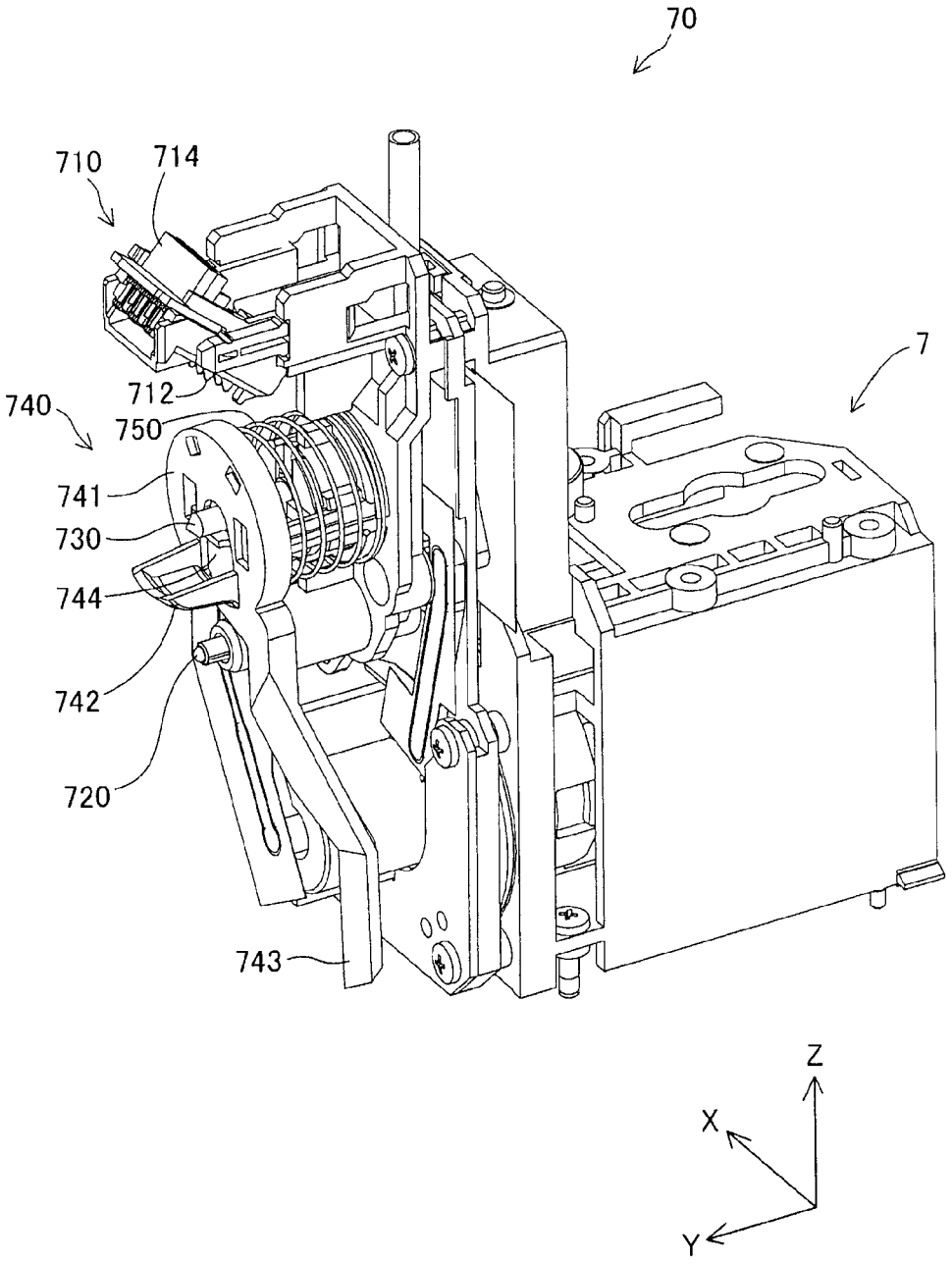
FIG. 6 is a perspective diagram illustrating the details of an ink introducing mechanism.

FIG. 1 is a diagram illustrating a schematic configuration of an ink jet type printing apparatus in which a cartridge is mounted as a liquid container. XYZ axes which are orthogonal to each other are drawn in FIG. 1. The XYZ axes of FIG. 1 correspond to the XYZ axes of other diagrams. The XYZ axes are given according to necessity for the diagrams which are illustrated below. In the present embodiment, the Z axis is the vertical direction (the direction of gravity), the Y axis is an attaching and detaching direction of a cartridge 40 with regard to a cartridge holder 60, and the X axis is a direction in which the plurality of cartridges 40 are lined up in the usage posture of a printing apparatus 10. More specifically, the +Z axis direction is the vertically upward direction, the −Z axis direction is the vertically downward direction, the +Y axis direction is a taking out direction of the cartridge 40, the −Y axis direction is an insertion direction of the cartridge 40, the +X axis direction is a direction of the side surface on which a predetermined label LB (refer to FIG. 4) is attached to the cartridge 40, and the −X axis direction is a direction of the rear surface thereof. Below, there are cases where the +Z axis direction is up, the −Z axis direction is down, the +Y axis direction is forward, and the −Y axis direction is backward. Here, the Z axis direction is also a direction in which an ink introducing needle 730 and a terminal 712 shown in FIG. 6 are lined up. The +Z axis direction is a direction from the ink introducing needle 730 to the terminal 712 and the −Z axis direction is the opposite direction thereto. In addition, the +Y axis direction is also a direction (refer to FIG. 15) in which an ink pack 43 is inserted in a case member 41 in a method of manufacturing the cartridge 40 which is described later. The Y axis direction corresponds to the "first direction" of the present application and the Z axis direction corresponds to the "second direction" of the present application.

The printing apparatus 10 which is the liquid consumption apparatus has an external shape which is substantially a box shape. A front surface cover 11 is provided in substantially the center of the front surface of the printing apparatus 10 and a plurality of operation buttons 15 are provided at the X axis direction side thereof. The front surface cover 11 is pivotally supported at the lower end side and when the upper end side falls toward the front, a paper discharge port 12 where printing paper is discharged is revealed. In addition, a paper feeding tray which is not shown in the diagram is provided at the rear surface side of the printing apparatus 10. When the printing paper is set in the paper feeding tray and the operation buttons 15 are operated, the printing paper is fed from the paper feeding tray and the printing paper is discharged from the paper discharge port 12 after images or the like are printed on the surface in the inner portion.

An upper surface cover 14 is provided at the upper surface side of the printing apparatus 10. The upper surface cover 14 is pivotally supported at the rear side, and when the upper surface cover 14 is opened by being lifted up to the front, it is possible to confirm the state of the inner portion of the printing apparatus 10 or perform repairs or the like to the printing apparatus 10.

An ejection head 20 which forms ink dots on the printing paper while reciprocating in a main scanning direction and a driving mechanism 30 which reciprocates the ejection head 20 are mounted in the inner portion of the printing apparatus 10. A plurality of ejection nozzles are provided at the bottom surface side (the side which faces the printing paper) of the ejection head 20 and ink is ejected toward the printing paper from the ejection nozzles.

The ink which is ejected from the ejection nozzles is contained in the cartridge 40. The cartridge 40 is loaded into the cartridge holder 60 which is provided at a separate position to the ejection head 20. The ink inside the cartridge 40 is supplied to the ejection head 20 through an ink tube 24. In the printing apparatus 10 of the present embodiment, a cartridge replacement cover 13 which is pivotally supported at the lower end side is provided to the immediate right of the front surface cover 11. It is possible to attach and detach the cartridge 40 to and from the cartridge holder 60 by the upper end side of the cartridge replacement cover 13 being made to fall to the front.

It is possible for the printing apparatus 10 to print color images using four types of ink which are cyan, magenta, yellow, and black. Ejection nozzles are provided for every type of ink in the ejection head 20. Ink inside the corresponding cartridge 40 is supplied to the respective ejection nozzles through the ink tubes 24 which are provided for every type of ink. Here, in the present embodiment, the printing apparatus 10 performs printing using four types of ink, but the printing may be performed using five or more types or three or less types of ink.

The driving mechanism 30 which reciprocates the ejection head 20 is provided with a timing belt 32 where a plurality of tooth shapes are formed on the inner side, a driving motor 34 for driving the timing belt 32, and the like. A portion of the timing belt 32 is fixed to the ejection head 20. When the timing belt 32 is driven, the ejection head 20 is reciprocated in the main scanning direction while being guided by a guide rail which extends in the main scanning direction and which is not shown in the diagram.

A region which is referred to as the home position is provided at a position which is outside the printing region where the ejection head 20 is moved in the main scanning direction. A maintenance mechanism is mounted at the home position. The maintenance mechanism is provided with a cap 80 which is pressed against a surface (a nozzle surface) where the ejection nozzles are formed at the bottom surface side of the ejection head 20 and which forms a closed space so as to surround the ejection nozzles, an elevating mechanism which is not shown in the diagram and which raises and lowers the cap 80 in order to push against the nozzle surface of the ejection head 20, a suction pump (which is not shown in the diagram) which introduces a negative pressure into the closed space which is formed by the cap 80 being pressed against the nozzle surface of the ejection head 20, and the like.

A paper feeding mechanism, which is not shown in the diagram for feeding the printing paper, and a control section 16, which controls the operation of the entire printing apparatus 10, are mounted in the inner portion of the printing apparatus 10. The control section 16 is provided with a CPU, a ROM, and a RAM. An operation where the ejection head 20 is reciprocated, an operation where the printing paper is fed, an operation where ink is ejected from the ejection nozzles, an operation where maintenance is performed so that correct printing is possible, and the like are all controlled by the control section 16.

Figure 2:
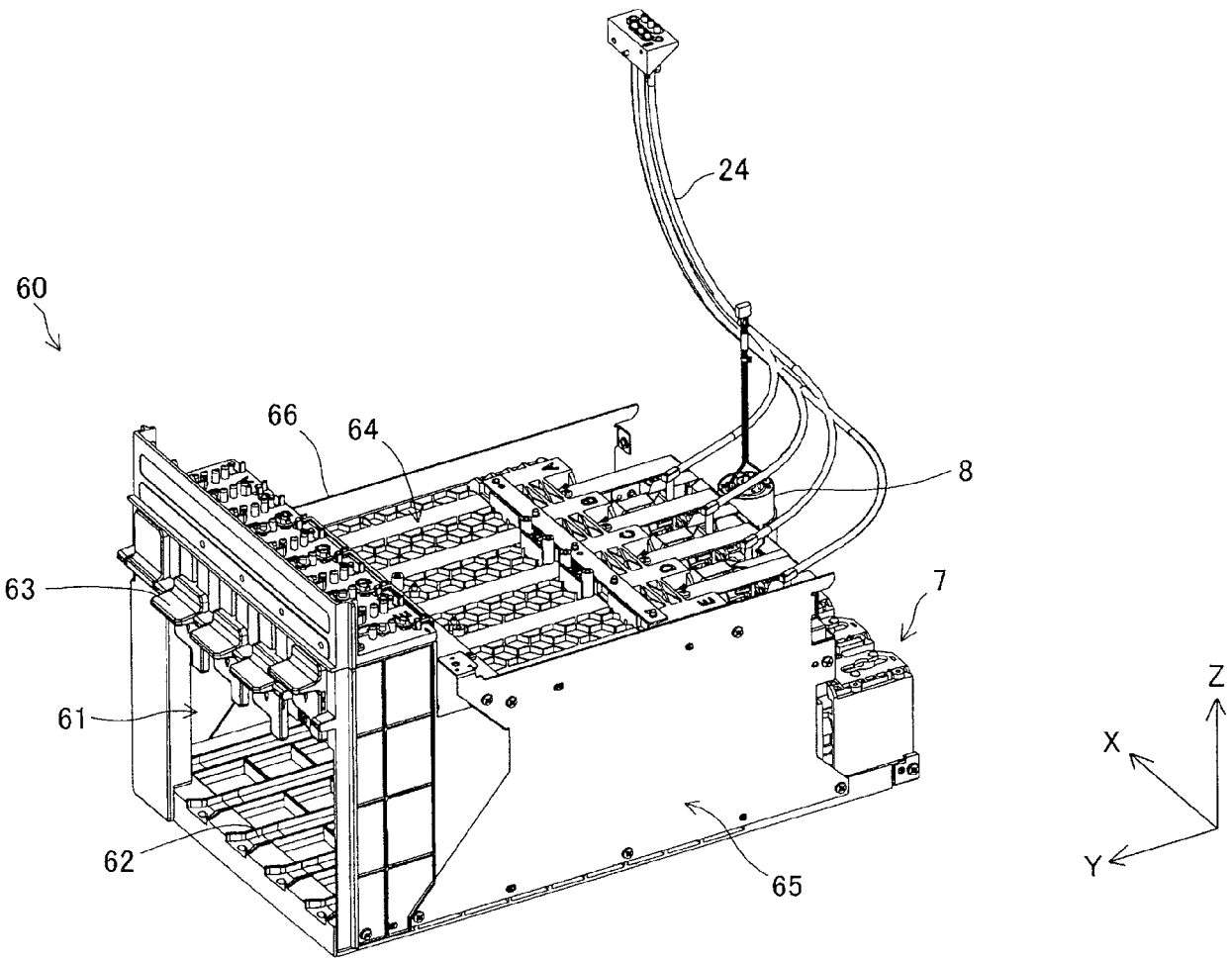
FIG. 2 is a detailed perspective diagram of the external appearance of a cartridge holder.

FIG. 2 is a detailed perspective diagram of the external appearance of the cartridge holder 60. A slot 61 where the cartridge 40 is inserted from the +Y axis direction to the −Y axis direction is provided in the cartridge holder 60. Guiding grooves 62 are provided for each of the cartridges 40 along the Y axis direction at the surface (the upper surface) of the +Z axis direction side and the surface (the bottom surface) of the Z axis direction side in the slot 61. Rail sections 413 and 414 (FIG. 3), which are provided in each of the surface (the upper surface) of the +Z axis direction side and the surface (the bottom surface) of the −Z axis direction side of the cartridge 40, fit into each of the guiding grooves 62 so as to slide when the cartridge 40 is mounted.

A fixing lever 63 for fixing the cartridge 40 is provided for every cartridge 40 in the upper portion of the entrance of the slot 61. When the fixing lever 63 is slid in the −Z axis direction, the fixing lever 63 fits together with a handle 415 (FIG. 3) of the cartridge 40 and the movement of the cartridge 40 in the +Y axis direction is regulated.

A pump unit 7 for suctioning the ink from the cartridge 40 is provided for every cartridge 40 in the end portion in the −Y axis direction of the cartridge holder 60. A pump driving motor 8 for driving the pump unit 7 is connected to each of the pump units 7. The ink which is suctioned by the pump unit 7 is supplied to the ejection head 20 through the ink tube 24.

Figure 3:
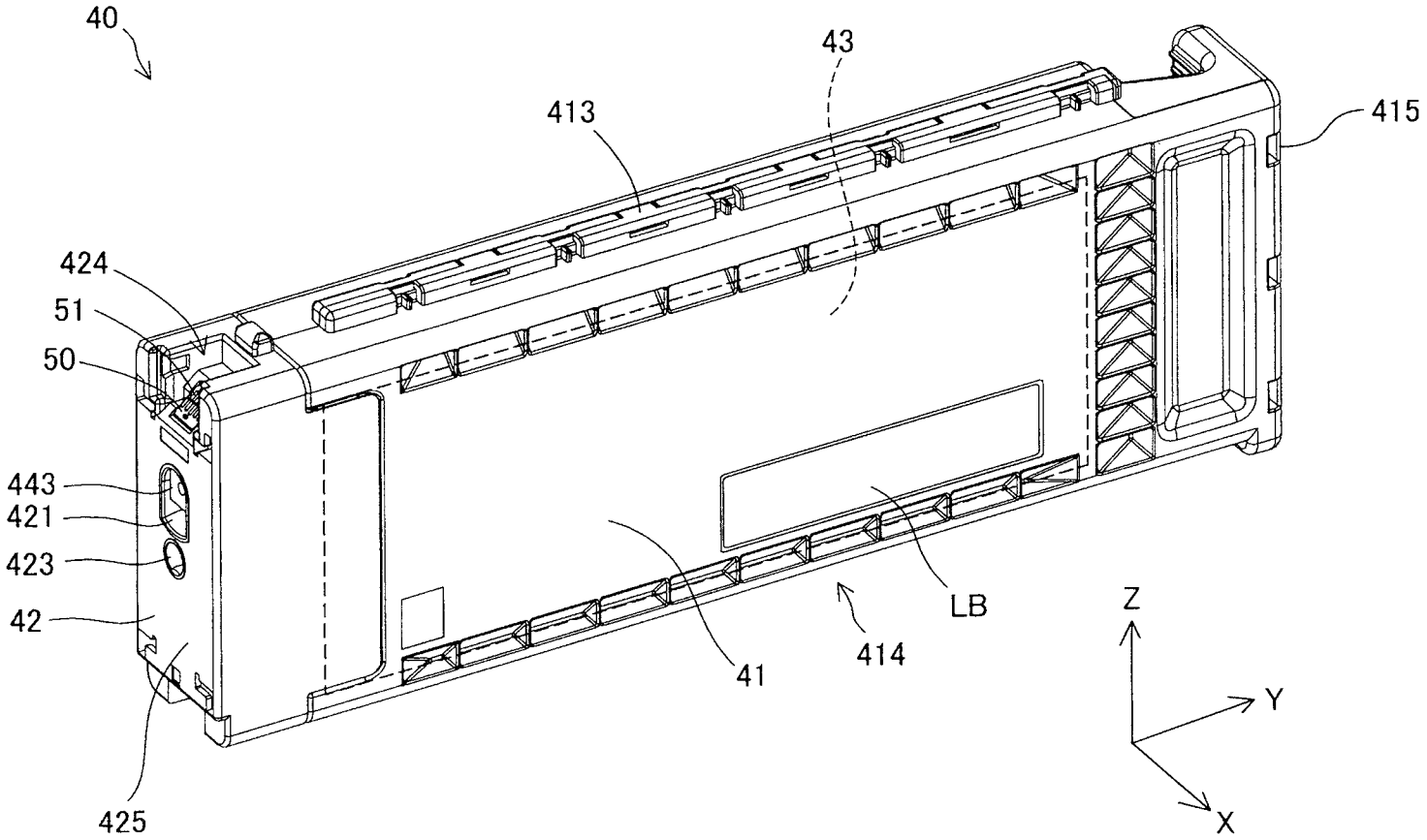
FIG. 3 is a perspective diagram of the external appearance of a cartridge.
Figure 4:
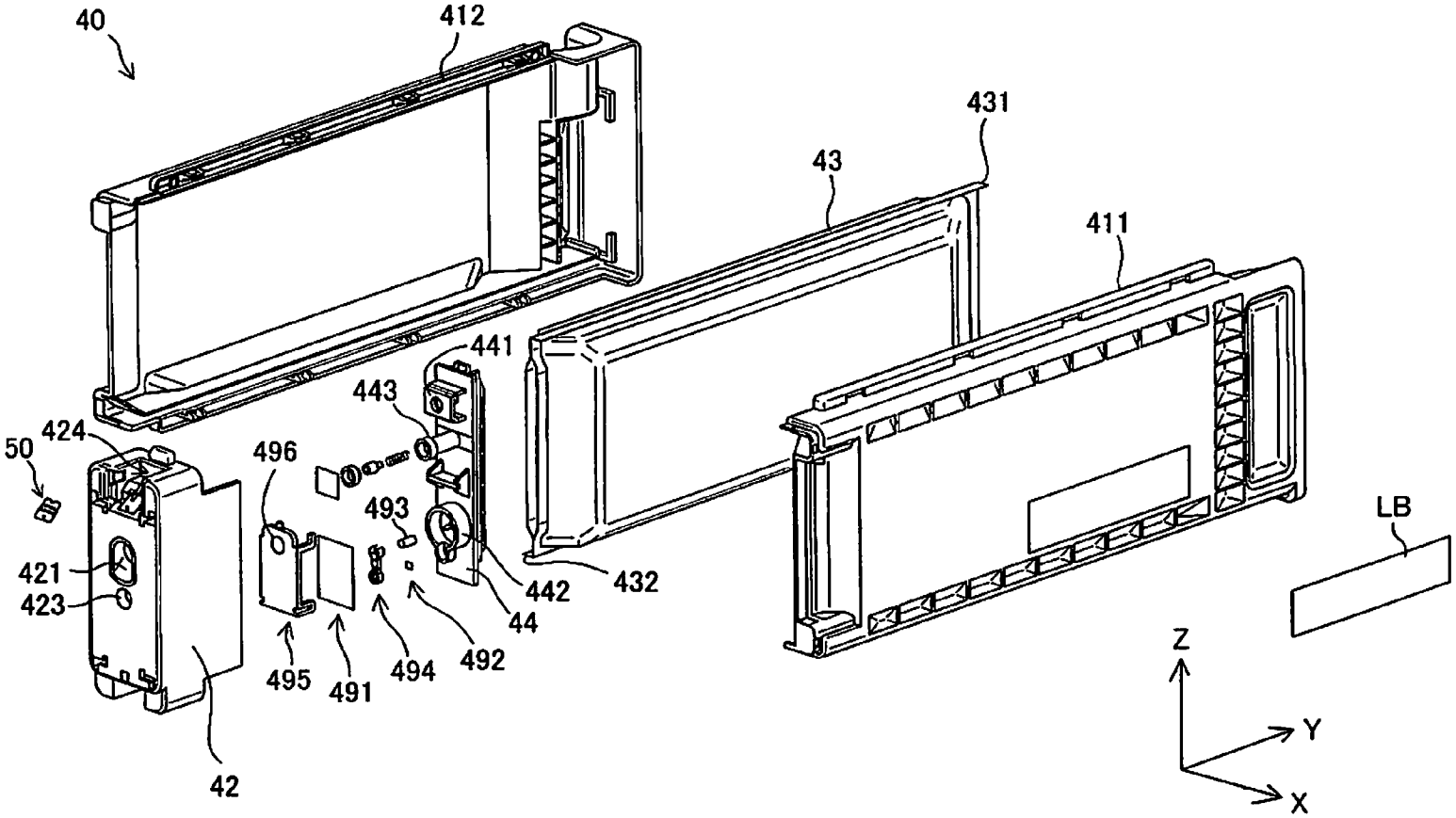
FIG. 4 is an exploded perspective diagram of the cartridge.

FIG. 3 is a perspective diagram of the external appearance of the cartridge 40. In addition, FIG. 4 is an exploded perspective diagram of the cartridge 40. The cartridge 40 is provided with the case member 41, a cover member 42, the flexible ink pack 43, and a liquid flow path member 44. The ink pack 43 corresponds to the "liquid containing bag" of the present application. The ink pack 43 is a so-called pillow type bag where the liquid flow path member 44 is fixed in the opening of the −Y axis direction. An upper end portion 431 (the end portion of +Z axis direction), a lower end portion 432 (the end portion of the −Z axis direction), and an end portion in the +Y axis direction of the ink pack 43 are formed with a flat shape.

The case member 41 is provided with a right case 411 and a left case 412. The handle 415 is provided at the end portion of the case member 41 in the +Y axis direction. The label LB is attached to the surface of the +X axis direction side of the right case 411. Rail portions 413 and 414 are formed along the Y axis direction on the surface in the +Z axis direction and the surface in the −Z axis direction in the case member 41. The rail portions 413 and 414 fit into the guiding grooves 62 of the cartridge holder 60 which is shown in FIG. 2 when the cartridge 40 is mounted inside the cartridge holder 60.

The liquid flow path member 44 is a member for supplying the ink which is filled into the ink pack 43 to the printing apparatus 10. The liquid flow path member 44 is adhered (fixed) to the opening portion of the ink pack 43 in the −Y axis direction. The liquid flow path member 44 is contained in the inner portion of the cover member 42 when the cover member 42 is attached to the opening portion of the end portion of the case member 41 in the −Y axis direction. The ink pack 43 is contained between the right case 411 and the left case 412 which configure the case member 41.

An ink filling port 441, an ink supply pipe 443, and an ink detection chamber 442 are disposed in this order from the end portion in the +Z axis direction toward the −Z axis direction on the surface (the surface of the opposite side to the ink pack 43) of the −Y axis direction side of the liquid flow path member 44. The ink filling port 441 is linked to the inner portion of the ink pack 43 and is provided in order to fill the ink into the ink pack 43. After the ink is filled into the ink pack 43 through the ink filling port 441, the ink filling port 441 is sealed.

The ink detection chamber 442 is linked to the inner portion of the ink pack 43 and is used in order to detect the state of the ink remaining inside the ink pack 43. A flexible film member 491 is provided on the surface of the −Y axis direction side of the ink detection chamber 442. A spring 493 is arranged through a pressure receiving member 494 between the film member 491 and the bottom surface (the inner surface of the +Y axis direction side) of the ink detection chamber 442. Ink flows in from the ink pack 43 into the ink detection chamber 442 through a check valve 492. A plate shaped sensor lever 495 is arranged at the −Y axis direction side of the film member 491. The end portion in the −Z axis direction of the sensor lever 495 is fixed to the liquid flow path member 44 so as to freely rotate. A contact section 496 is provided at the surface of the −Y axis direction side of the end portion in the +Z axis direction of the sensor lever 495. The end portion in the +Y axis direction of a rod member 720 (FIG. 6) which is provided at the printing apparatus 10 side abuts against the contact section 496 through a sensor hole 423 which is provided in the cover member 42. For example, in a case where ink is present in a predetermined amount or more in the ink pack 43, the total of the pressure of the ink inside the ink detection chamber 442 (the pressure inside the ink pack) and the force of the spring 493 exceeds the pressing force of the rod member 720 in the +Y axis direction. As a result, the film member 491, the sensor lever 495, and the rod member 720 are displaced in the −Y axis direction. On the other hand, in a case where ink is less than a predetermined amount (in a case where the ink has ended), the total of the pressure of the ink inside the ink detection chamber 442 (the pressure inside the ink pack) and the force of the spring 493 is less than the pressing force of the rod member 720 in the +Y axis direction. As a result, the film member 491, the sensor lever 495, and the rod member 720 are displaced in the +Y axis direction.

The ink supply pipe 443 is used for supplying ink to the printing apparatus 10. The ink supply pipe 443 is linked to the ink detection chamber 442 by a flow path which is formed in the inner portion of the liquid flow path member 44. As a result, ink flows in from inside the ink pack 43 into the ink supply pipe 443 through the ink detection chamber 442. Here, in the present embodiment, the cartridge 40 is provided with the ink detection chamber 442, but may be configured without the ink detection chamber 442 being provided. In this case, the ink supply pipe 443 is directly linked to the inside of the ink pack 43.

A substrate 50, a supply pipe hole 421, and the sensor hole 423 are disposed in this order from the end portion in the +Z axis direction toward the −Z axis direction in the cover member 42 on an abutting surface 425 of the −Y axis direction side which abuts against the printing apparatus 10 side.

The substrate 50 is inclined upward and attached to a concave portion 424 which is provided in the end portion in the +Z axis direction of the cover member 42. A storage device which is not shown in the diagram is mounted at the rear surface (the surface of the +Y axis direction side) of the substrate 50. In addition, a plurality of terminals 51 (FIG. 3) which are electrically connected to the storage device are provided at the surface (the surface of the −Y axis direction side) of the substrate 50. When the cartridge 40 is mounted on the cartridge holder 60, the terminal 712 (FIG. 6) of the printing apparatus 10 side which is provided in the cartridge holder 60 comes into contact with the terminals 51 of the surface of the substrate 50. By doing so, it is possible for the control section 16 of the printing apparatus 10 to access the storage apparatus which is provided in the cartridge 40.

The ink supply pipe 443 which is provided in the liquid flow path member 44 is exposed inside the supply pipe hole 421. The supply pipe hole 421 is recessed in the +Y axis direction and has a predetermined depth. The inner wall of the downward direction (the −Z axis direction) of the supply pipe hole 421 is inclined to rise up in the +Z axis direction further heading from the −Y axis direction to the +Y axis direction. In other words, the inner wall of the downward direction (the −Z axis direction) of the supply pipe hole 421 is inclined to fall in the −Z axis direction further heading from the +Y axis direction to the −Y axis direction. The supply pipe hole 421 is positioned vertically above the contact section 496 of the sensor lever 495 described above.

The rod member 720 (FIG. 6) which is provided in the printing apparatus 10 is inserted in the sensor hole 423. As described above, when the cartridge 40 is mounted in the cartridge holder 60, the end portion in the +Y axis direction of the rod member 720 abuts against the contact section 496 of the sensor lever 495 which is provided in the liquid flow path member 44 through the sensor hole 423.

Figure 5:
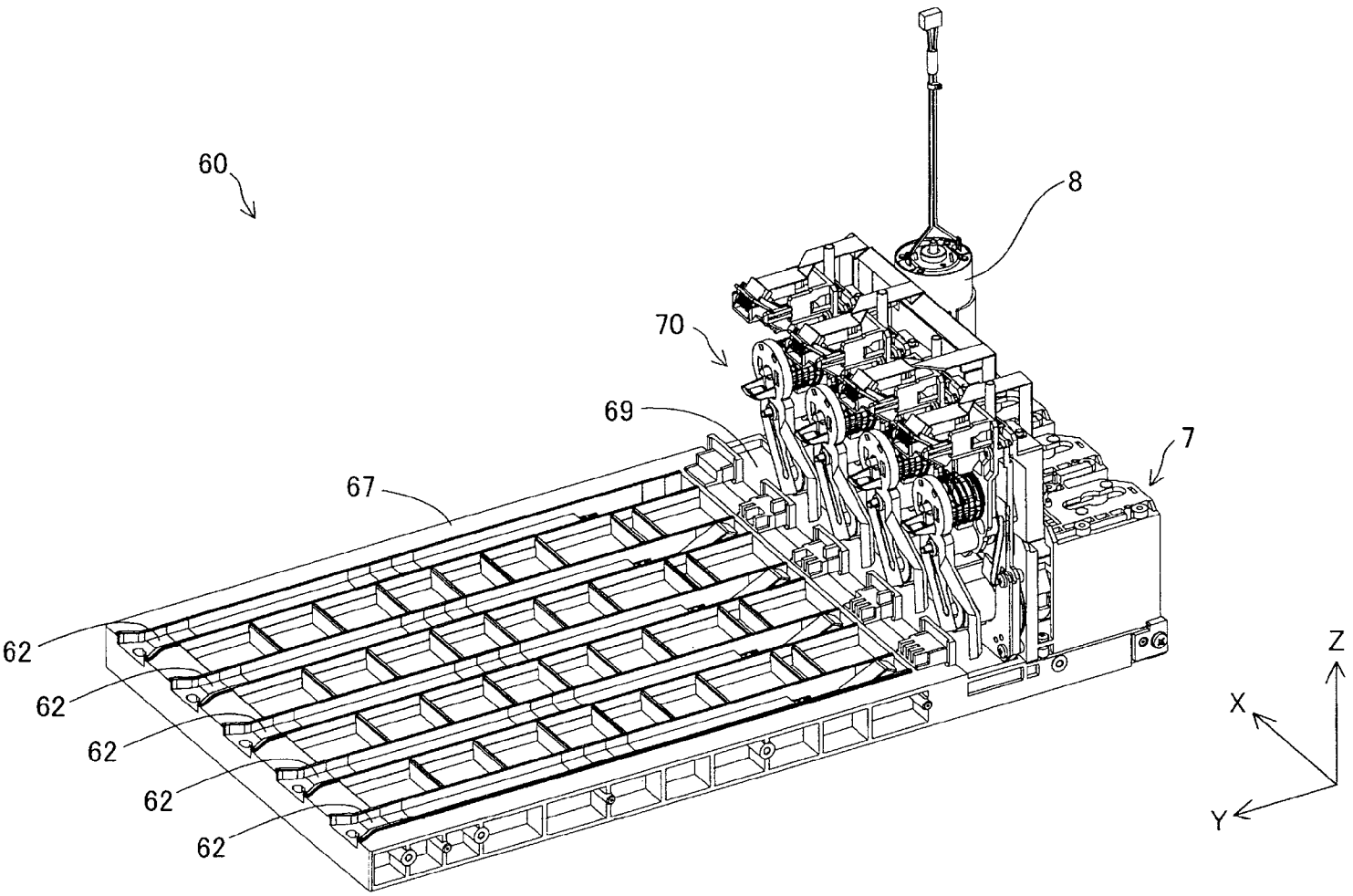
FIG. 5 is a perspective diagram illustrating a configuration of an inner portion of the cartridge holder.

FIG. 5 is a perspective diagram illustrating a configuration of an inner portion of the cartridge holder 60. FIG. 5 shows a state in which a lid 64 and side plates 65 and 66 of the cartridge holder 60 are removed from the perspective diagram shown in FIG. 2. As shown in FIG. 5, ink introducing mechanisms 70 are set up for every cartridge 40 to be adjacent to the end portion in the −Y axis direction of the guiding groove 62 which is provided on a bottom plate 67 in the inner portion of the cartridge holder 60. The pump unit 7 is connected to each ink introduction mechanism 70. An ink absorbing material 69 is arranged at the bottom portion of the ink introducing mechanism 70.

FIG. 6 is a perspective diagram illustrating the details of the ink introducing mechanism 70. The ink introducing mechanism 70 is provided with a substrate contacting section 710, the rod member 720, the ink introducing needle 730, and an ink receiving member 740.

The substrate contacting section 710 is provided at the end portion in the +Z axis direction of the ink introducing mechanism 70. When the cartridge 40 is mounted in the cartridge holder 60, the substrate contacting section 710 has the terminal 712 which electrically contacts with the terminals 51 on the substrate 50 which is provided in the cartridge 40. A connector 714 is provided on the rear surface side of the terminal 712. The connector 714 is connected to the control section 16 through a predetermined cable.

The rod member 720 is provided at substantially the center portion in the Z axis direction of the ink introducing mechanism 70. When the cartridge 40 is mounted in the cartridge holder 60, the end portion in the +Y axis direction of the rod member 720 is inserted into the sensor hole 423 and comes into contact with the contact section 496 of the sensor lever 495 which is provided in an ink supply member 480. The end portion of the −Y axis direction side of the rod member 720 is positioned inside the ink introducing mechanism 70, and the position thereof is detected by a photo sensor which is provided inside the ink introducing mechanism 70. The control section 16 detects the state of the ink remaining inside the cartridge 40 according to the changes in the position of the end portion of the rod member 720 in the −Y axis direction which are detected by the photo sensor.

The ink introducing needle 730 is provided between the substrate contacting section 710 and the rod member 720 in the Z axis direction. When the cartridge 40 is mounted in the cartridge holder 60, the ink introducing needle 730 is inserted (connected) to the ink supply pipe 443 which is provided in the cartridge 40. An ink introducing port is provided in the lower portion of the tip end (the end portion of the +Y axis direction) of the ink introducing needle 730. The ink inside the cartridge 40 is introduced inside the printing apparatus 10 through the ink introducing port.

The ink receiving member 740 is a member for catching the ink which drips from the ink introducing port of the ink introducing needle 730 when the cartridge 40 is removed. The ink receiving member 740 is attached to the ink introducing mechanism 70 so as to interpose a spring 750. The ink receiving member 740 is pressed in the +Y axis direction by the spring 750 in a state where the cartridge 40 is not attached to the cartridge holder 60. The ink receiving member 740 is configured by integrally forming a substantially circular abutting section 741, a receiving tray 742, and a drain member 743. An opening 744 is provided in the abutting section 741 to span across the position of the base end (the end portion of the −Y axis direction) of the receiving tray 742 from the center of the abutting section 741 toward the −Z axis direction. The ink introducing needle 730 protrudes from the opening 744. The receiving tray 742 is provided at the lower portion of the opening 744 in the surface of the +Y axis direction side of the abutting section 741. In addition, the drain member 743 which extends downward from the abutting section 741 is provided in the lower portion of the abutting section 741. The drain member 743 is bent to the −X axis direction side in order to avoid the rod member 720 which is positioned under the ink introducing needle 730. When the ink which has dripped from the ink introduction port of the ink introducing needle 730 is caught by the receiving tray 742, the ink is transferred in the drain member 743 and absorbed by the ink absorbing material 69 which is provided in the bottom plate 67 of the cartridge holder 60.

Above, the configuration of the printing apparatus 10 and the cartridge 40 has been described. Below, the method of manufacturing the cartridge 40 is described along with the detailed configuration of the case member 41.

Figure 7:
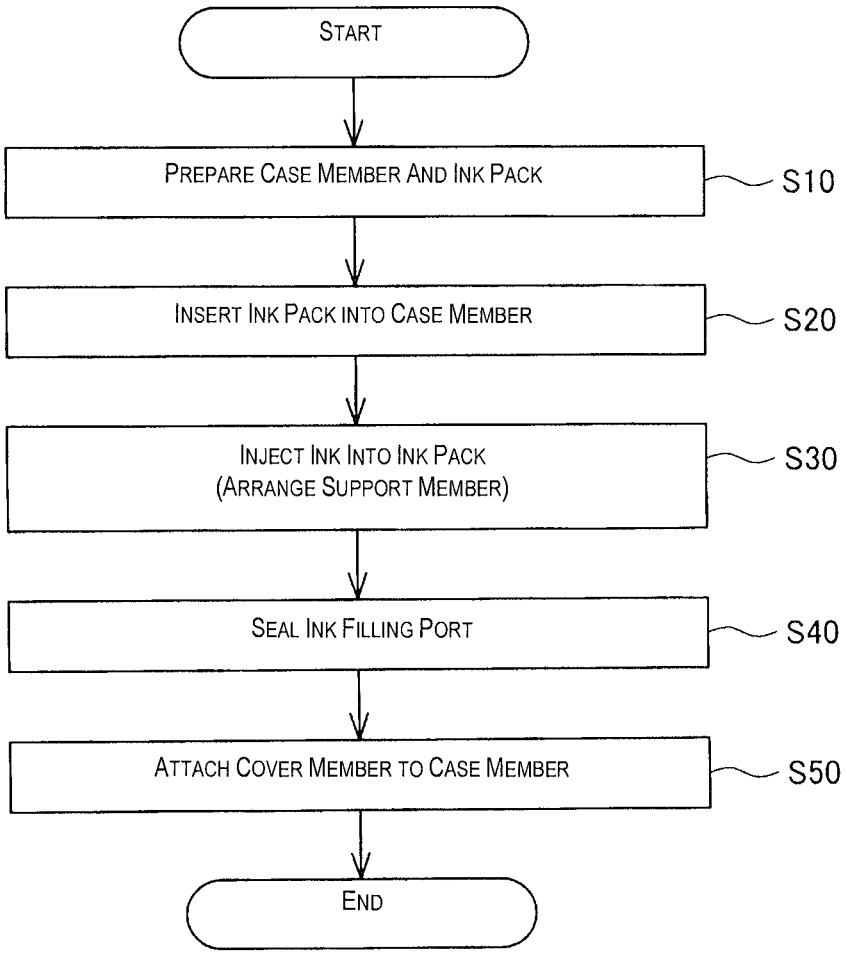
FIG. 7 is a flow chart of a method of manufacturing the cartridge.

FIG. 7 is a flow chart of a method of manufacturing the cartridge 40. In the manufacturing method in the present embodiment, first, the case member 41 and the ink pack 43 are prepared (step S10). Specifically, the case member 41, where the right case 411 and the left case 412 are assembled, together and the ink pack 43, where the liquid flow path member 44 is attached and which is not filled with ink, are prepared.

Figure 8:
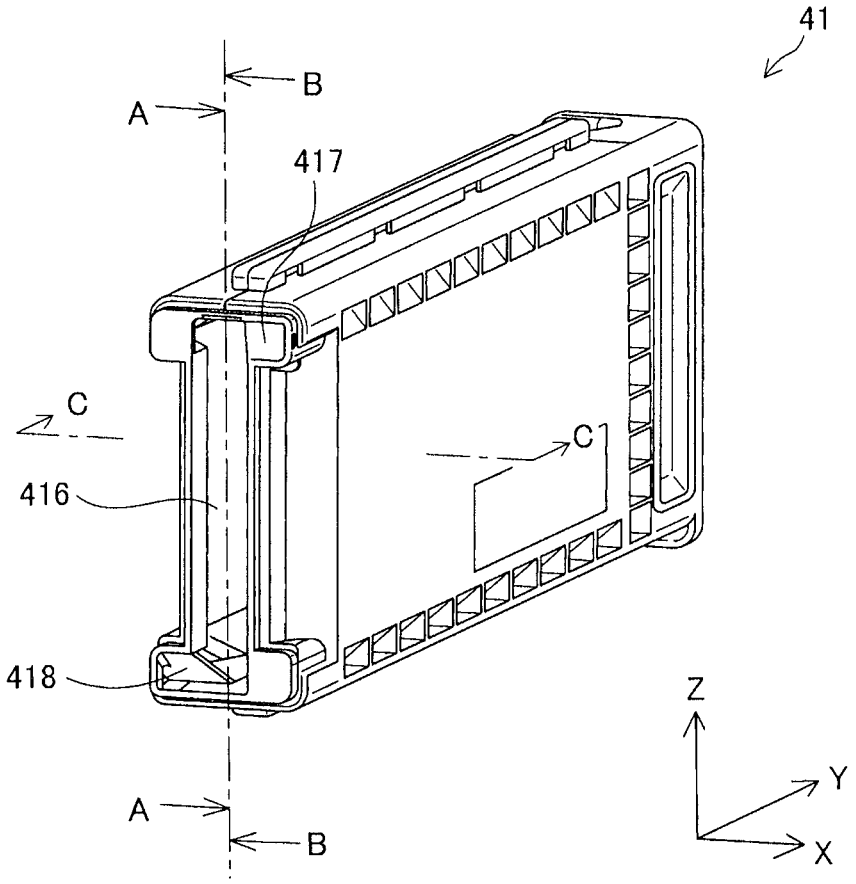
FIG. 8 is a perspective diagram of the case member.

FIG. 8 is a perspective diagram of the case member 41 which is prepared in step S10 described above. An opening 416 which extends in the Z axis direction is provided in the central portion in the end surface in the Y axis direction of the case member 41. The upper end (the end portion in the +Z axis direction) of the opening 416 is extended in the +X axis direction and the lower end (the end portion in the −Z axis direction) is extended in the −X axis direction.

Figure 9:
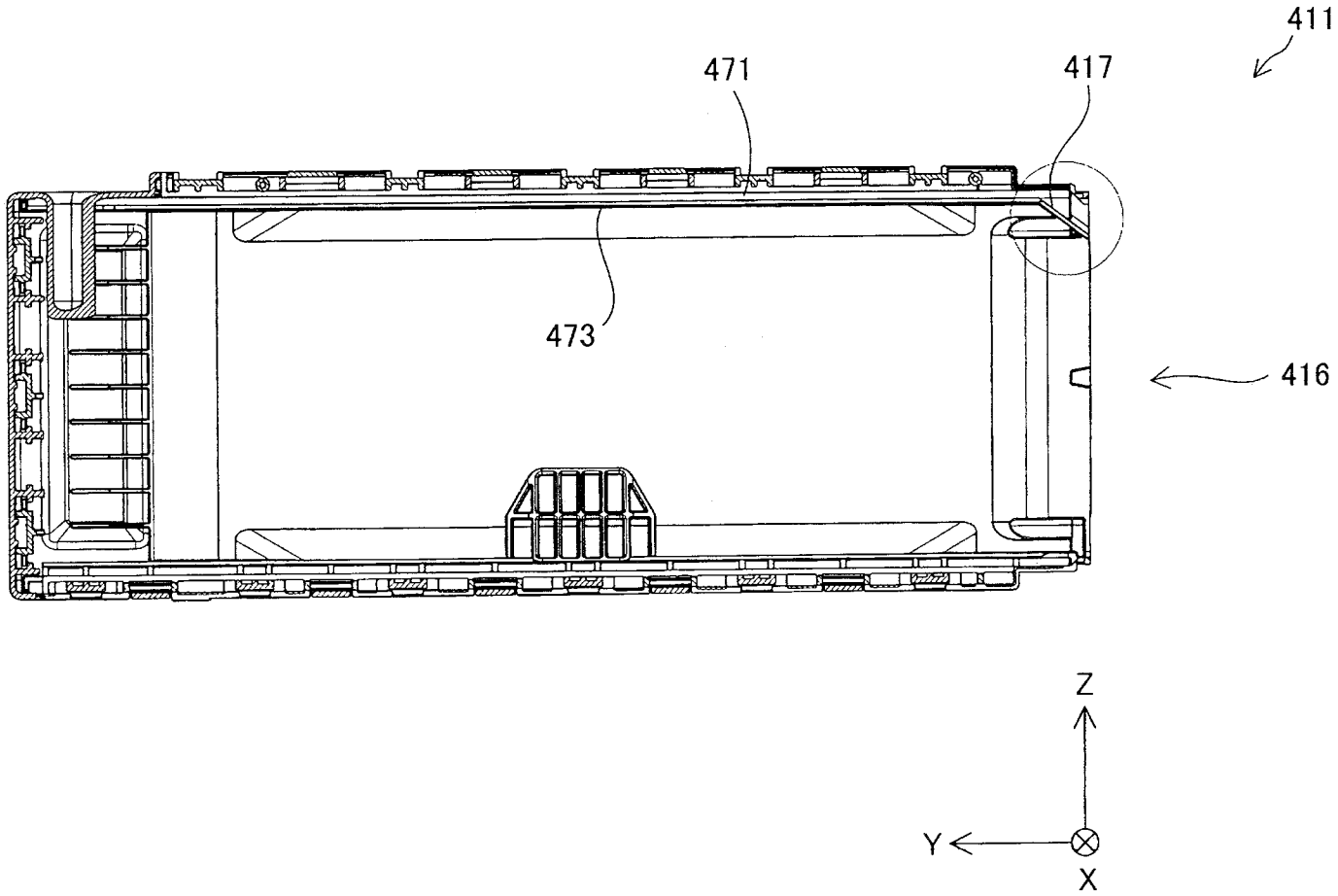
FIG. 9 is a diagram illustrating a cross section A-A of the case member in FIG. 8.

FIG. 9 is a diagram illustrating a cross section A-A of the case member 41 in FIG. 8. That is, FIG. 9 is a diagram where the right case 411 (FIG. 4) is viewed from the −X axis direction side. As shown in FIG. 9 and FIG. 8, an upper side inclined wall 417, which is inclined to the +Z axis direction side while heading toward the +Y axis direction, is provided in the upper end of the opening 416 of the right case 411.

Figure 10:
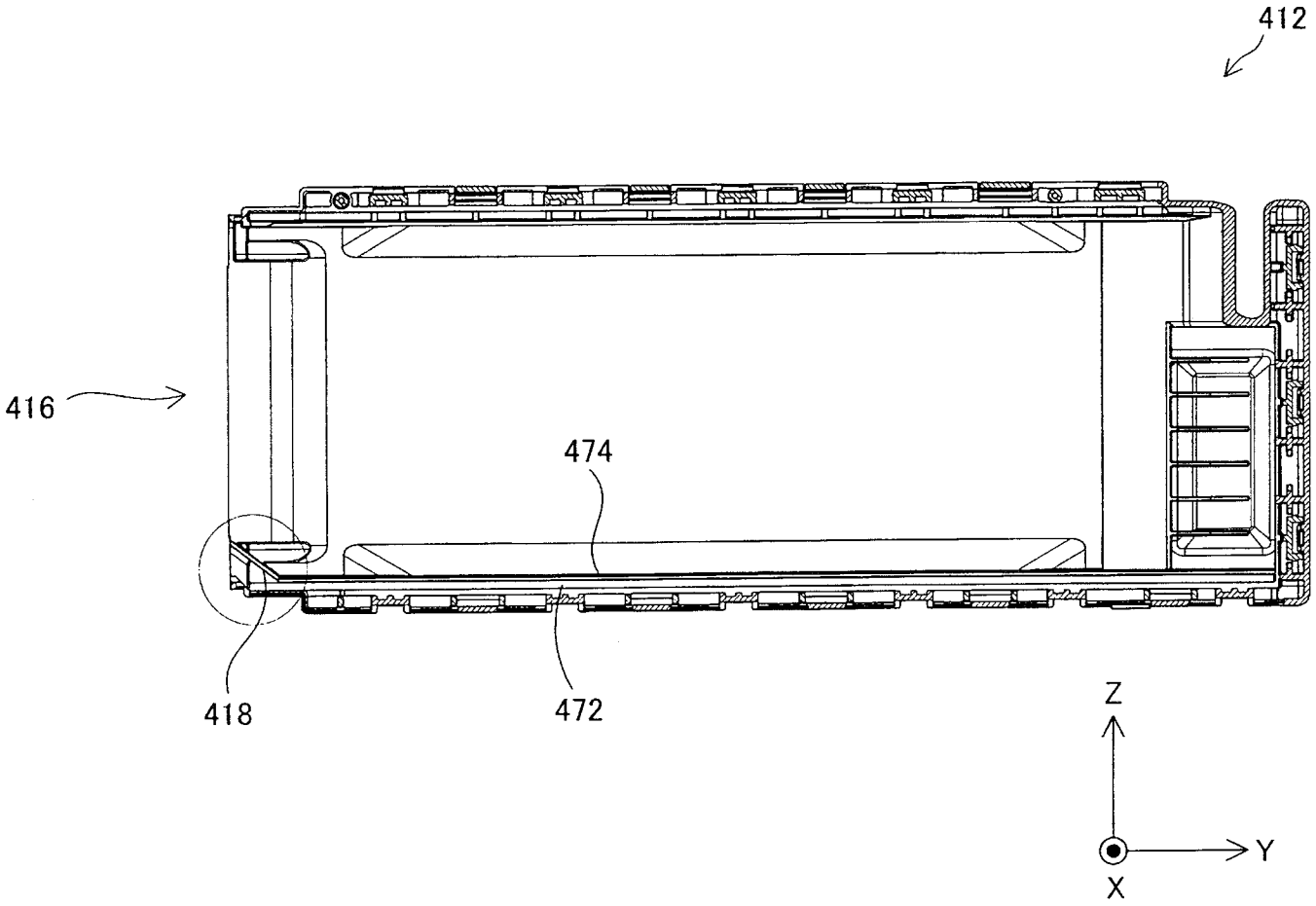
FIG. 10 is a diagram illustrating a cross section B-B of the case member in FIG. 8.

FIG. 10 is a diagram illustrating a cross section B-B of the case member 41 in FIG. 8. That is, FIG. 10 is a diagram where the left case 412 (FIG. 4) is viewed from the +X axis direction side. As shown in FIG. 10 and FIG. 8, a lower side inclined wall 418, which is inclined to the −Z axis direction side while heading toward the +Y axis direction, is provided in the lower end of the opening 416 of the left case 412.

Figure 11:
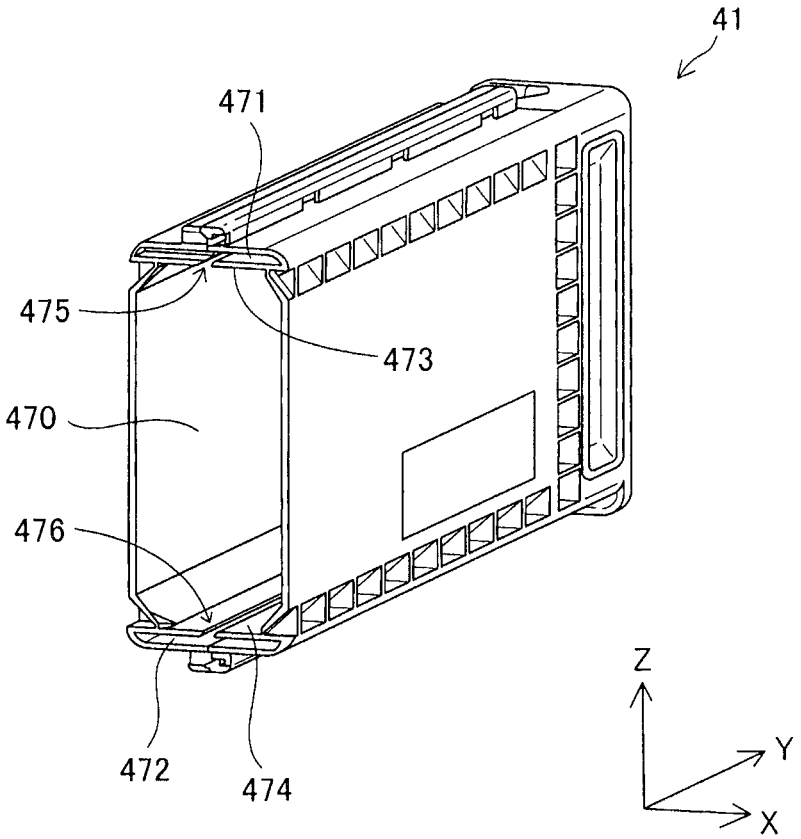
FIG. 11 is a diagram illustrating a cross sectional configuration of the case member along the line C-C of FIG. 8.

FIG. 11 is a diagram illustrating a cross sectional configuration of the case member 41 along the line C-C of FIG. 8. The inner portion space of the case member 41 is partitioned into a main portion containing section 470 (one example of a main portion accommodating section) where the main portion of the ink pack 43 is contained, an upper side end portion containing section 471 (one example of an end portion accommodating section) where the flat upper end portion 431 of the ink pack 43 is contained, and a lower side end portion containing section 472 (one example of an end portion accommodating section) where the flat lower end portion 432 of the ink pack 43 is contained. The main portion of the ink pack 43 is a portion which is filled with ink and is the portion which excludes the flat end portions.

The main portion containing section 470 is positioned at the center of the inner portion of the case member 41. The upper side end portion containing section 471 is adjacent to the +Z axis direction side of the main portion containing section 470. The lower side end portion containing section 472 is adjacent to the −Z axis direction side of the main portion containing section 470. The main portion containing section 470 and the upper side end portion containing section 471 are partitioned by an upper side partition wall 473 along the XY plane. The main portion containing section 470 and the lower side end portion containing section 472 are partitioned by a lower side partition wall 474 along the XY plane. Slits 475 and 476 are respectively provided along the Y axis direction in the central portions in the upper side partition wall 473 and the lower side partition wall 474. The upper side end portion containing section 471 is a space with a plate shape along the upper side partition wall 473. In addition, the lower side end portion containing section 472 is a space with a plate shape along the upper side partition wall 474. The thicknesses of the upper side end portion containing section 471 and the lower side end portion containing section 472 in the Z axis direction and the widths of the slits 475 and 476 in the X axis direction are greater than the thicknesses of the flat upper end portion 431 or the lower end portion 432 of the ink pack 43.

Figure 12A:
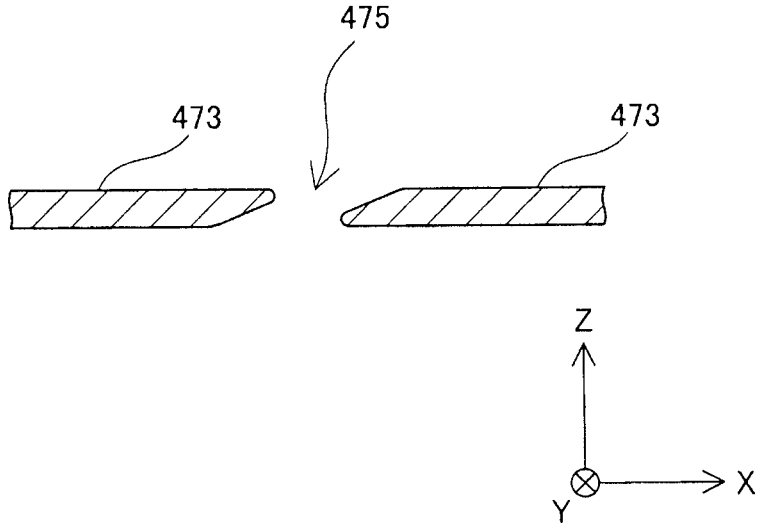
FIGS. 12A and 12B are diagrams illustrating an enlarged cross section of the periphery of a slit.

FIG. 12A is a diagram illustrating an enlarged cross section of the periphery of the slit 475. A chamfering process is carried out in the slit 475 which is formed in the upper side partition wall 473. Specifically, the boundary between the portion of the −X axis direction side out of the two portions of the upper side partition wall 473 which sandwich the slit 475 and the slit 475 is subjected to chamfering along the Y axis direction of the upper side partition wall 473 such that the corner portion of the lower side (the -Z axis direction side) is inclined. In addition, the boundary between the portion of the +X axis direction side out of the two portions of the upper side partition wall 473 which sandwich the slit 475 and the slit 475 is subjected to chamfering on the upper side partition wall 473 along the Y axis direction such that the corner portion of the upper side (the +Z axis direction side) is inclined. That is, the opposing surfaces of the upper side partition wall 473 which is divided by the slit 475 are each inclined in the same direction so as to become parallel. In a case where the upper end portion 431 of the ink pack 43 is inserted into the slit 475 in a manufacturing process which will be described later if the slit 475 is formed in the upper side partition wall 473, it is easy for the upper end portion 431 of the ink pack 43 to bend to the +X axis direction side where the upper side inclined wall 417 is formed. Here, in the present embodiment, all of the opposing surfaces of the upper side partition wall 473 which is divided by the slit 475 are chamfered, but only one may be chamfered.

Figure 12B:
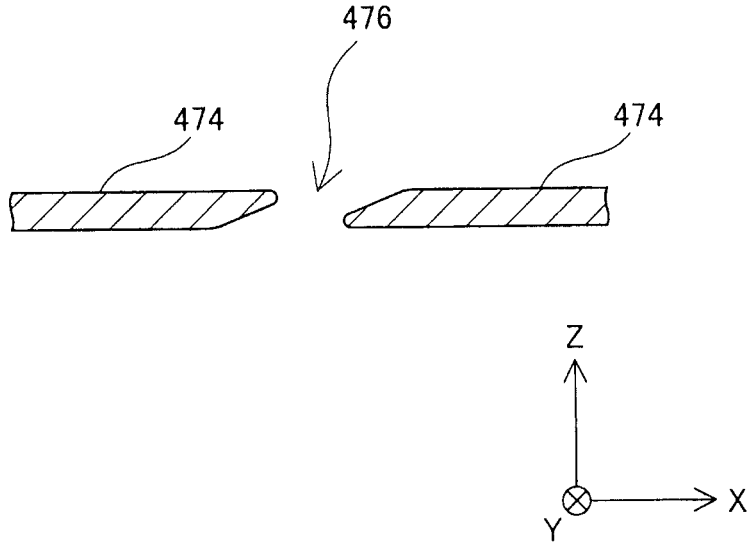

FIG. 12B is a diagram illustrating an enlarged cross section of the periphery of the slit 476. The same type of chamfering as that for the slit 475 which was formed in the upper side partition wall 473 is also carried out for the slit 476 which was formed in the lower side partition wall 474. In a case where the lower end portion 432 of the ink pack 43 is inserted into the slit 476 in a manufacturing process which will be described later if the slit 476 is formed in the lower side partition wall 474, it is easy for the lower end portion 432 of the ink pack 43 to bend to the −X axis direction side where the lower side inclined wall 418 is formed. Here, in the present embodiment, all of the opposing surfaces of the lower side partition wall 474 which is divided by the slit 476 are chamfered, but only one may be chamfered.

The main portion containing section 470 shown in FIG. 11 is linked to the opening 416 of the −Y axis direction end surface of the case member 41. In the present embodiment, the inner circumference of the XZ cross section of the main portion containing section 470 has a substantially hexagonal shape. In the present embodiment, the length of the outer circumference in the XZ cross section of the ink pack 43 is longer than the length of the inner circumference in the XZ cross section of the main portion containing section 470 by the amount where the flat upper end portion 431 and lower end portion 432 are formed. In addition, the length of the inner circumference in the XZ cross section of the main portion containing section 470 and the length of the inner circumference in the XZ cross section of the ink pack 43 are substantially equal. Here, in the present embodiment, the inner circumference of the XZ cross section of the main portion containing section 470 is a substantially hexagonal shape, but the inner circumference may be a substantially rectangular shape, or may be another polygonal shape. In addition, for example, the corner portion may be configured by a curve.

In the upper side partition wall 473 which forms the upper side end portion containing section 471, out of the two portions which sandwich the slit 475, the upper surface of the side (the +X axis direction side), in which the upper side inclined wall 417 is formed, is connected to the upper surface of the upper side inclined wall 417 (refer to FIGS. 8 and 9). In addition, in the upper side partition wall 474 which forms the lower side end portion containing section 471, out of the two portions which sandwich the slit 476, the lower surface of the side (the −X axis direction side), in which the lower side inclined wall 418 is formed, is connected to the lower surface of the lower side inclined wall 418 (refer to FIGS. 8 and 10).

Figure 13:
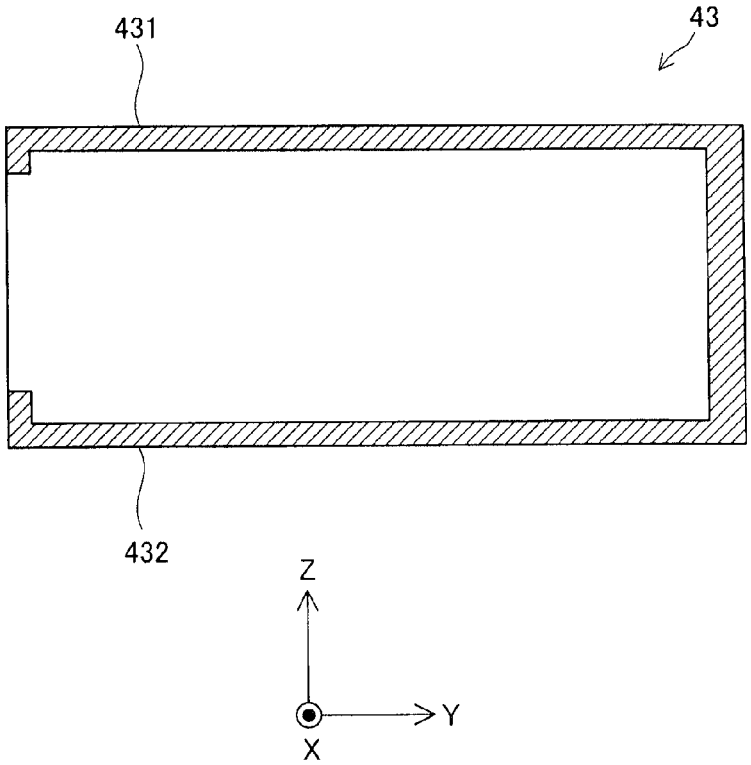
FIG. 13 is a side surface diagram of an ink pack.

FIG. 13 is a side surface diagram of the ink pack 43 which is prepared in step S10. The ink pack 43 is a so-called pillow type bag. In the present embodiment, the ink pack 43 is formed by bonding together two flexible film members with the upper end portion 431, the lower end portion 432, and the end portion in the +Y axis direction. The hatched portion in the drawing shows a location where two film members are adhered and flattened. As shown in FIG. 4, the liquid flow path member 44 is fixed (adhered) to the end portion in the −Y axis direction of the ink pack 43.

Figure 14:
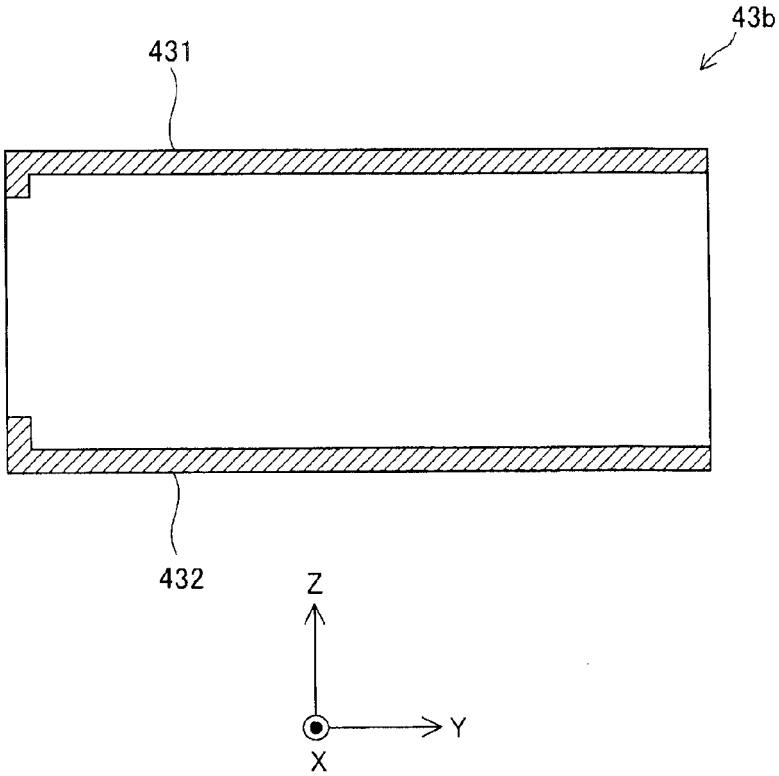
FIG. 14 is a diagram illustrating another embodiment of the ink pack.

FIG. 14 is a diagram illustrating another embodiment of the ink pack. An example where two flexible film members are bonded together is shown in FIG. 13, but an example where an ink pack 43*b* is formed by folding and joining one film member which is long in the Y axis direction with the central portion thereof is shown in FIG. 14. In the present embodiment, the ink pack shown in either of FIG. 13 or FIG. 14 may be prepared.

In the step S10 shown in FIG. 7, when the case member 41 and the ink pack 43 which are described above are prepared, next, the ink pack 43 is inserted into the case member 41 (step S20).

Figure 15:
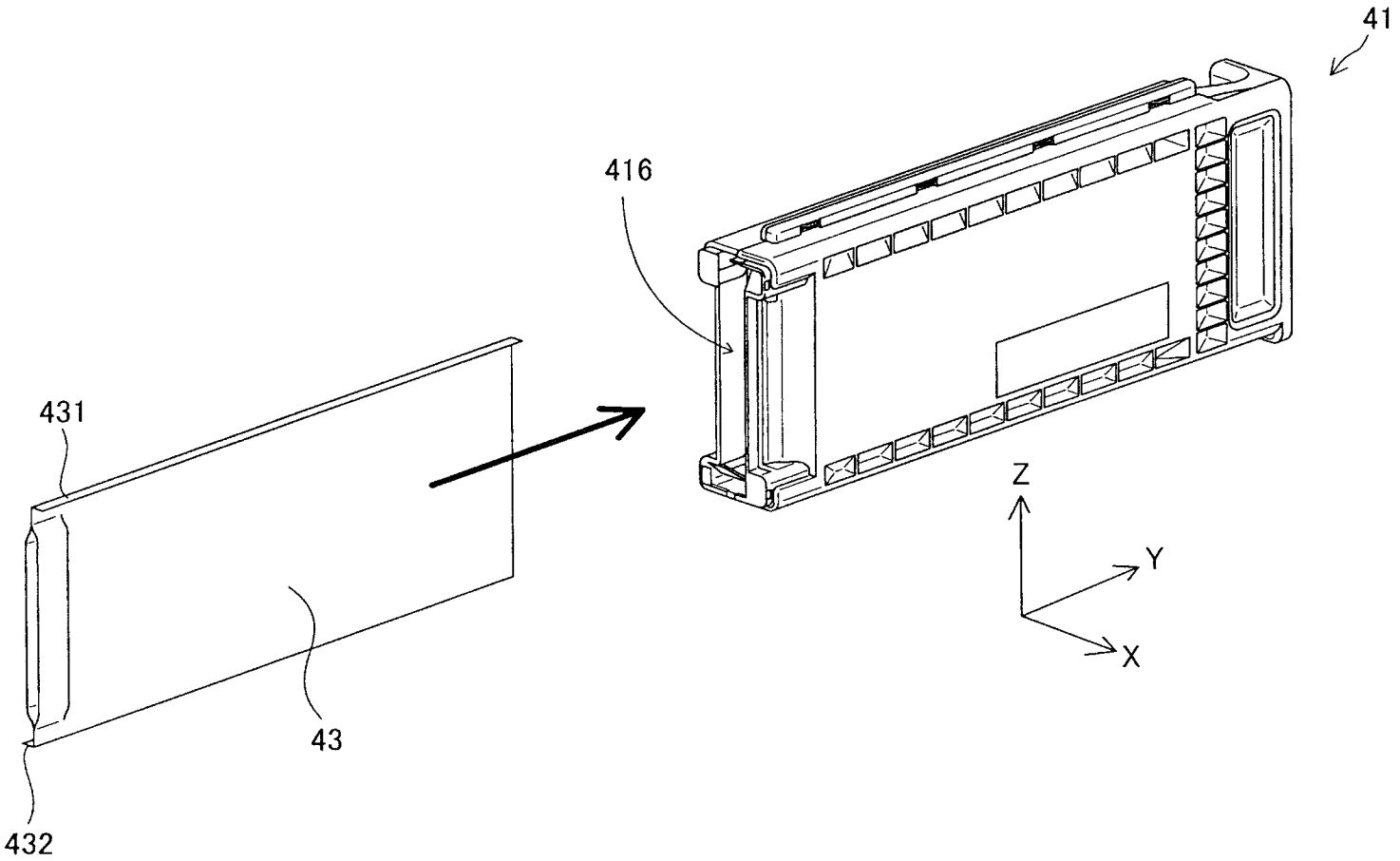
FIG. 15 is a diagram illustrating a state in which the ink pack is inserted in the case member.

FIG. 15 is a diagram illustrating a state in which the ink pack 43 is inserted in the case member 41. Illustration of the liquid flow path member 44 is omitted in FIG. 15. In the step S20 which is described above, the end portion in the +Y axis direction of the ink pack 43 is inserted from the opening 416 which is formed in the end surface in the −Y axis direction of the cartridge 40. At this time, the upper end portion 431 of the ink pack 43 is folded back in the +X axis direction and the lower end portion 432 of the ink pack 43 is folded back in the opposite direction to the upper end portion 431, that is, in the −X axis direction. By doing so, the folded back portion of the upper end portion 431 is inserted along the upper side inclined wall 417 which is provided in the upper portion of the opening 416 of the cartridge 40 and the folded back portion of the lower end portion 432 is inserted along the lower side inclined wall 418 which is provided in the lower portion of the opening 416 of the cartridge 40.

Figure 16:
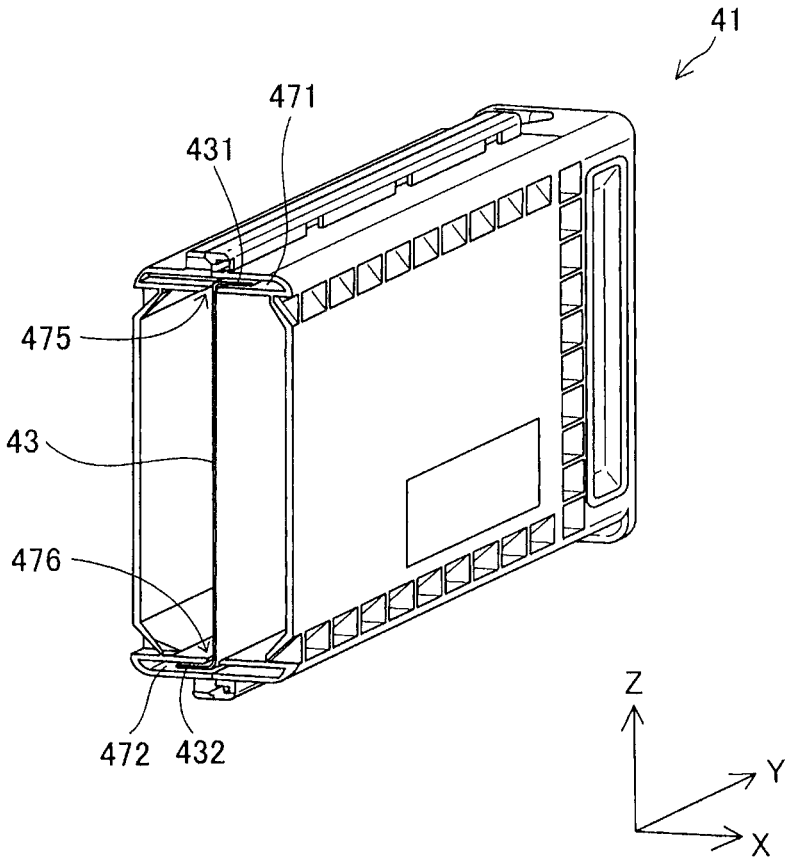
FIG. 16 is a diagram illustrating a configuration of an inner portion of the case member.

FIG. 16 is a diagram illustrating a configuration of an inner portion of the case member 41 in a state where the ink pack 43 is inserted into the case member 41. FIG. 16 illustrates a cross section C-C of the case member 41 in FIG. 8. As shown in FIG. 16, when the ink pack 43 is inserted into the case member 41, the upper end portion 431 of the ink pack 43 passes through the slit 475 and is contained in the space at the +X axis direction side of the upper side end portion containing section 471 in the case member 41 and the lower end portion 432 passes through the slit 476 and is contained in the space at the −X axis direction side of the lower side end portion containing section 472. The main portion of the ink pack 43 is contained in the main portion containing section 470. In this manner, the ink pack 43 is folded back into an S shape and contained in the case member 41.

In step S20 shown in FIG. 7, when the ink pack 43 is inserted into the case member 41, ink is filled (step S30) inside the ink pack 43 through the ink filling port 441 (FIG. 4).

Figure 17:
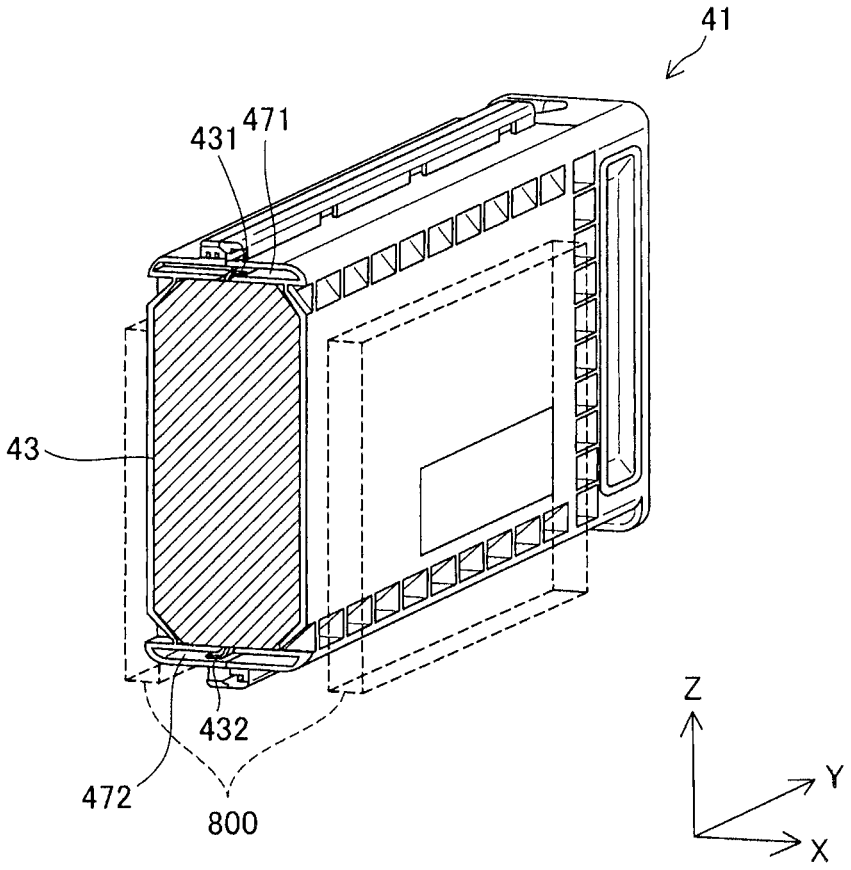
FIG. 17 is a diagram illustrating a state in which ink is filled into the ink pack.
Figure 18:
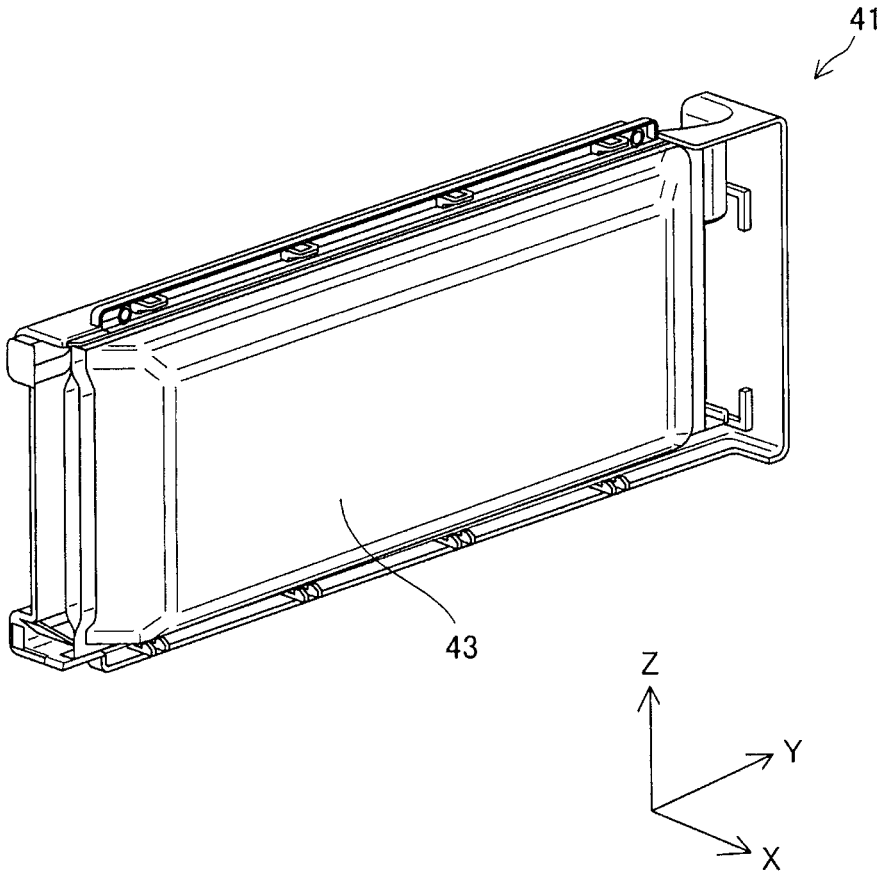
FIG. 18 is a diagram illustrating a state in which ink is filled into the ink pack.

FIG. 17 and FIG. 18 are diagrams illustrating a state in which ink is filled into the ink pack 43. FIG. 17 illustrates a cross section C-C of the case member 41 in FIG. 8. FIG. 18 illustrates a state where the right case 411 is removed from the case member 41. The portion with hatching in FIG. 17 illustrates a portion which is filled with ink. As shown in FIG. 17 and FIG. 18, when the ink is filled into the ink pack 43, the ink pack 43 swells along the inner wall of the case member 41 and the ink spreads to almost all of the space inside the main portion containing section 470. In the present embodiment, the upper end portion 431 of the ink pack 43 remains inserted into the slit 475 and the lower end portion 432 also remains inserted into the slit 476 even when the ink is filled into the ink pack 43. In this manner, if the upper end portion 431 and the lower end portion 432 of the ink pack 43 remain inserted into the slits 475 and 476 even after the filling of the ink, the upper end portion 431 and the lower end portion 432 of the ink pack 43 are contained once more in the upper side end portion containing section 471 and the lower side end portion containing section 472 as shown in FIG. 16 even in a case where the amount of ink remaining inside the ink pack 43 is reduced in accompaniment with the consumption of the ink by the printing apparatus 10. As a result, the folding back of the ink pack 43 into the main portion containing section 470 or the generating of wrinkles is suppressed. As a result, since ink remaining in the folded back portion or a wrinkled portion is suppressed, it is possible to consume the ink without waste.

When the ink is filled into the ink pack 43 in the step S30, it is preferable that support members 800 which have higher rigidity than the case member 41 be arranged at each of the surface of the +X axis direction side and the surface of the −X axis direction side of the case member 41. By arranging the support members 800, the ink pack 43 is suppressed from swelling excessively in the X axis direction in which swelling most easily occurs in accompaniment with the filling operation of the ink, and it is possible to spread the ink to every corner in the Z axis direction and the Y axis direction. As shown in FIG. 17, for example, the support members 800 are configured by two metal plates which are opposed and a configuration is possible in which the cartridge 40 is interposed therebetween. In addition, it is possible for the support members 800 to have a configuration with a box shape in which one surface or two surfaces which are opposed are opened, and for there to be a configuration where the cartridge 40 is fitted in from this opening.

In the step S30 shown in FIG. 7, when ink is filled into the ink pack 43, the ink filling port 441 is sealed (step S40). In the manufacturing method of the present embodiment, sealing is performed by carrying out thermal caulking on the ink filling port 441. When the ink filling port 441 is sealed, lastly, the cover member 42 is attached to the case member 41 and the series of manufacturing processes of the cartridge 40 is finished.

According to the cartridge 40 of the present embodiment which is described above, the inner portion of the case member 41 of the cartridge 40 is partitioned into three chambers of the main portion containing section 470, the upper side end portion containing section 471, and the lower side end portion containing section 472, and the slits 475 and 476 are provided in the upper side partition wall 473 and the lower side partition wall 474, which partition these chambers, along the direction in which the ink pack 43 is inserted in the inner portion of the case member 41. As a result, it is possible to easily contain the ink pack 43 inside the case member 41 by inserting the flat upper end portion 431 and the lower end portion 432 of the ink pack 43 through into the slits 475 and 476 during the manufacturing of the cartridge 40. In addition, in the present embodiment, since the injecting of the ink is performed in a state where it is possible for the upper end portion 431 and the lower end portion 432 of the ink pack 43 to be freely inserted through into the slits 475 and 476 in the Z axis direction, it is possible to inject the ink into every corner without generating wrinkles or folding in the ink pack 43.

In addition, in the present embodiment, the upper side inclined wall 417 which is connected to the upper side partition wall 473 and the lower side inclined wall 418 which is connected to the lower side partition wall 474 are provided in the opening 416 of the case member 41 where the ink pack 43 is inserted. As a result, the opening connected to the upper side end portion containing section 471 and the lower side end portion containing section 472 becomes wider toward the opening 416. As a result, it is possible to smoothly insert the upper end portion 431 and the lower end portion 432 of the ink pack 43 inside the upper side end portion containing section 471 and the lower side end portion containing section 472.

Furthermore, in the present embodiment, chamfering is carried out in the slits 475 and 476 along the direction in which the upper end portion 431 and the lower end portion 432 of the ink pack 43 are each folded and curved. As a result, when the ink pack 43 contracts or expands, it is possible for the upper end portion 431 and the lower end portion 432 of the ink pack 43 to easily pass through the slits 475 and 476. As a result, the upper end portion 431 and the lower end portion 432 of the ink pack 43 are smoothly accommodated in the flat upper side end portion containing section 471 and the upper side end portion containing section 472. In addition, in the present embodiment, the upper end portion 431 and the lower end portion 432 of the ink pack 43 are each gradually contained inside the upper side end portion containing section 471 and inside the lower side end portion containing section 472 in accompaniment with the consumption of the ink. As a result, the ink pack 43 is not folded back inside the main portion containing section 470 and wrinkles are not generated. As a result, it is possible to consume the ink without waste.

In addition, in the present embodiment, the length of the inner circumference along the Z axis direction of the ink pack 43 is substantially the same as the length of the inner circumference along the Z axis direction of the main portion containing section 470. As a result, since it is possible for the ink pack 43 to expand to every corner inside the main portion containing section 470, it is possible to inject the ink after maximizing the space inside the case member 41. Here, the reason that the two lengths are "substantially the same" and not exactly the same is because the ink pack 43 has a thickness.

Furthermore, in the present embodiment, the ink is injected into the ink pack 43 after the ink pack 43 is inserted into the case member 41. As a result, it is possible to form the cartridge 40 considerably more easily than by insertion into the case member 41 after the ink is injected into the ink pack 43. In addition, in the present embodiment, the upper end portion 431 and the lower end portion 432 of the ink pack 43 are contained in the upper side end portion containing section 471 and the lower side end portion containing section 472 and the ink is injected into the ink pack 43 in a state where the main portion of the ink pack 43 is contained in the main portion containing section 470. As a result, when the ink pack 43 expands in accompaniment with the injecting of the ink, it is possible to suppress the ink pack 43 from folding back inside the case member 41 or becoming wrinkled. As a result, it is possible to easily perform the injecting of the ink.

Above, an embodiment of the present invention has been described, but the present invention is not limited to such an embodiment and is able to be realized in various forms within a range which does not depart from the scope of the invention.

For example, without being limited to the printing apparatus and the cartridge thereof, it is also possible for the present invention to be applied to an arbitrary liquid ejecting apparatus which ejects another liquid other than ink and a liquid containing vessel thereof. For example, application is possible to the following various types of liquid ejecting apparatuses and liquid containing vessels thereof.

(1) An image recording apparatus such as a facsimile apparatus (2) A coloring material ejecting apparatus which is used in the manufacturing of color filters for image display apparatuses such as liquid crystal displays (3) An electrode material ejecting apparatus which is used in the forming of electrodes such as an organic EL (electroluminescence) display, a surface emitting display (Field Emission Display, FED), or the like (4) A liquid ejecting apparatus which ejects a liquid which includes bio organic matter which is used in bio chip manufacturing (5) A sample ejecting apparatus which is a precision pipette (6) A lubricant ejecting apparatus (7) A resin liquid ejecting apparatus (8) A liquid ejecting apparatus which ejects lubricant in a pin point manner into precision machinery such as a watch or a camera (9) A liquid ejecting apparatus which ejects a transparent resin liquid such as an ultraviolet ray curable resin liquid onto a substrate in order to form a micro hemispherical lens (optical lens) or the like which is used in an optical communication element or the like

(10) A liquid ejecting apparatus which ejects an acidic or alkaline etching liquid for etching a substrate or the like

(11) A liquid ejecting apparatus which is provided with a liquid ejecting head which discharges liquid droplets in other arbitrary minute amounts Here, "liquid droplet" refers to a state of liquid which is discharged from a liquid ejecting apparatus, and includes droplets which have a trail in a granular shape, a teardrop shape, or a thread shape. In addition, it is sufficient if the "liquid" as used here is a material which is able to be ejected by a liquid ejecting apparatus. For example, it is sufficient if the "liquid" is a material in a state where a substance is in a liquid phase and the "liquid" includes materials in a liquid state with high or low viscosity, and materials in a liquid state such as sols, gel water, other inorganic solvents, organic solvents, solutions, liquid resins, and liquid metals (metal melts). In addition, the "liquid" includes not only liquids as a single substance state but also where particles of a functional material which is formed of solid matter such as a pigment or metal particles are dissolved, dispersed, or mixed into a solvent. In addition, typical examples of the liquid include ink, as described in the embodiment described above, liquid crystals, or the like. Here, the ink includes various types of liquid compositions such as gel inks and hot melt inks in addition to general water based inks and oil based inks.

The invention claimed is:

1. A liquid container comprising:

a liquid containing bag including a flat end portion extending in a first direction, the flat end portion of the liquid containing bag being formed by bonding a flexible film member;

a liquid flow path member supplying liquid in the liquid containing bag to a liquid consumption apparatus, the liquid flow path member being fixed to the liquid containing bag; and a case member defining an opening at one end and accommodating the liquid containing bag inserted from the opening in the first direction, the case member having an end portion accommodating section extending in the first direction and accommodating at least the end portion of the liquid containing bag, a main portion accommodating section accommodating a main portion of the liquid containing bag, and a partition wall partitioning the flat end portion accommodating section and the main portion accommodating section, the partition wall including a slit extending along the first direction, with the end portion of the liquid containing bag being inserted through the slit, the flat end portion being provided in the liquid containing bag which is a separate member from the liquid flow path member.

2. The liquid container according to claim 1, wherein an end portion of at the one end of the slit and an end portion at the one end of the end portion accommodating section communicate with the opening, and the end portion at the one end of the end portion accommodating section is widened toward the opening.

3. The liquid container according to claim 1, wherein a portion of the partition wall where the slit is formed is chamfered.

4. The liquid container according to claim 1, wherein a length of an inner circumference along a second direction of the liquid containing bag and a length of an inner circumference along the second direction of the main portion accommodating section are substantially the same.

5. The liquid container according to claim 1, wherein liquid is injected into the liquid containing bag in a state where the end portion is accommodated in the end portion accommodating section and the main portion is accommodated in the main portion accommodating section.

6. A liquid consumption apparatus comprising:

the liquid container according to claim 1, the liquid consumption apparatus being configured and arranged to consume liquid contained in the liquid container.

7. A liquid container adapted to be mounted in a liquid consumption apparatus and to accommodate a liquid containing bag including a main portion filled with liquid and an end portion other than the main portion, and a liquid flow path member supplying liquid in the liquid containing bag to the liquid consumption apparatus, the end portion of the liquid containing bag being formed by bonding a flexible film member and the liquid flow path member being fixed to the liquid containing bag, the liquid container comprising:

a case including an end portion accommodating section configured and arranged to accommodate the end portion of the liquid containing bag;

a main portion accommodating section configured and arranged to accommodate the main portion of the liquid containing bag; and a slit through which the end portion of the liquid containing bag is inserted, the slit extending along a first direction which is a mounting direction in which the liquid container is mounted to the liquid consumption apparatus, the end portion being provided in the liquid containing bag which is a separate member from the liquid flow path member.

8. The liquid container according to claim 7, wherein one side of the case is opened, and the end portion accommodating section is widened toward the opening.

9. The liquid container according to claim 7, wherein a portion of a wall of the case where the slit is formed is chamfered.

10. The liquid container according to claim 7, wherein a length of the liquid containing bag and a length of the main portion accommodating section are substantially the same in a second direction orthogonal to the first direction.

11. The liquid container according to claim 7, wherein liquid is injected into the liquid containing bag in a state where the end portion of the liquid containing bag is accommodated in the end portion accommodating section and the main portion of the liquid containing bag is accommodated in the main portion accommodating section.

12. A liquid consumption apparatus comprising: liquid container according to claim 7, the liquid consumption apparatus being configured to consume liquid contained in the liquid container.

13. The liquid container according to claim 1, wherein the case member includes a first case and a second case, and the opening is defined between the first case and the second case at one end of the case member to accommodate the liquid containing bag inserted from the opening in the first direction in a state where the first case and the case are assembled.

14. The liquid container according to claim 7, wherein the case includes a first case and a second case, and the case has an opening defined between the first case and the second case at one end of the case to accommodate the liquid containing bag inserted from the opening in a state where the first case and the case are assembled.

* * * * *